US005148991A

United States Patent [19]

Kah, Jr.

[11] Patent Number: 5,148,991

[45] Date of Patent: Sep. 22, 1992

[54] GEAR DRIVEN TRANSMISSION FOR OSCILLATING SPRINKLERS

[76] Inventor: Carl L. C. Kah, Jr., 778 Lakeside Dr., N. Palm Beach, Fla. 33408

[21] Appl. No.: 626,993

[22] Filed: Dec. 13, 1990

[51] Int. Cl.[5] ..... B05B 3/16

[52] U.S. Cl. ..... 239/242

[58] Field of Search ..... 239/237, 240, 242

[56] References Cited

U.S. PATENT DOCUMENTS 3,645,451 2/1972 Hauser ..... 239/242 X 4,955,542 4/1990 Kah, Jr. ..... 239/242

*Primary Examiner*—Andres Kashnikow

*Assistant Examiner*—Kevin P. Weldon

*Attorney, Agent, or Firm*—Jack N. McCarthy

[57] ABSTRACT

A gear driven oscillating sprinkler head has a gear train transmitting rotational drive from a drive motor to the oscillating sprinkler head with a shifting drive mechanism which includes alternately engageable driving devices providing oscillation. An over-center spring maintains the direct driving engagement bias for a driving device on each side of a center position of the shifting drive mechanism. An over center spring carry device places a bias against the shifting drive mechanism to move the shifting drive mechanism over its center position once a driving device has become disengaged from driving the sprinkler head, during a reversing action, so that the over-center spring now biases the shifting drive mechanism in the alternate driving engagement position. Adjustable arc of oscillation includes adjustment to full circle rotation.

33 Claims, 15 Drawing Sheets

FIG. 11
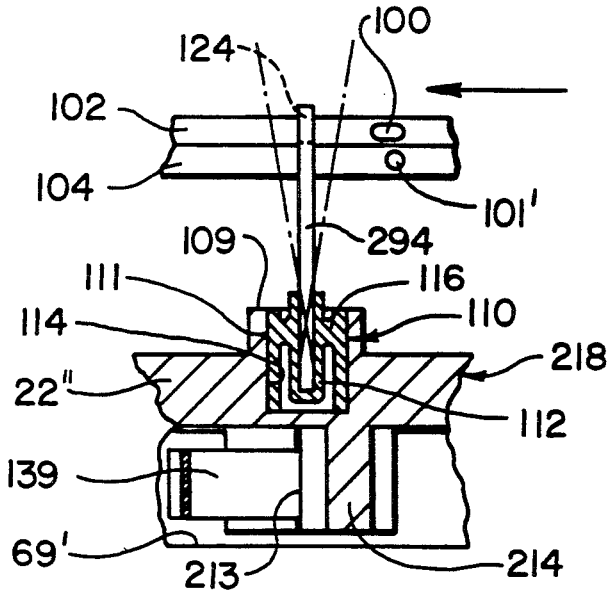
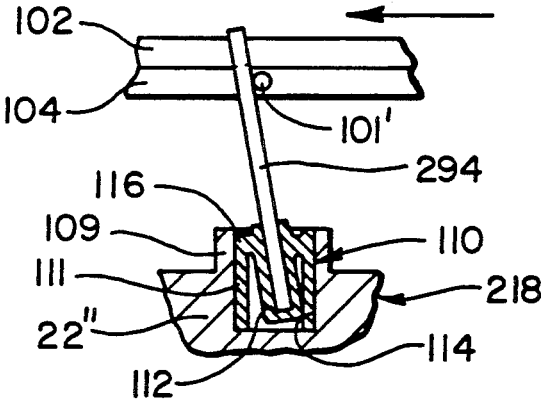
FIG. 11A

FIG. 15
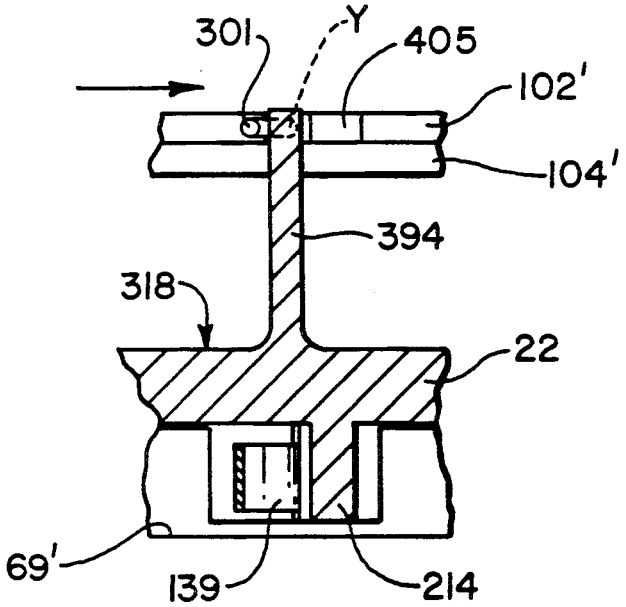
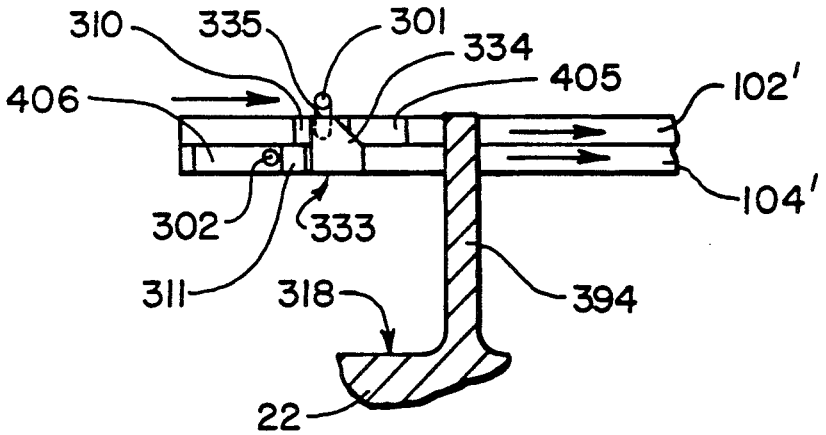
FIG. 16

GEAR DRIVEN TRANSMISSION FOR OSCILLATING SPRINKLERS

TECHNICAL FIELD

This invention relates to sprinklers which provide water precipitation over a desired area.

CROSS REFERENCE

U.S. patent application Ser. No. 932,470, filed Nov. 18, 1986, for "A Transmission Device Having an Adjustable Oscillating Output", U.S. Pat. No. 4,867,378, for "Sprinkler Device", U.S. Pat. No. 4,901,924, for a "Sprinkler Device with Angular Control", and U.S. Pat. No. 4,955,544, for a "Reversing Transmission for Oscillating Sprinkler", all filed by Carl L. C. Kah, Jr., are related to this application.

BACKGROUND ART

Rotatable sprinklers have been known in the prior art for use in irrigation. Patents setting forth a background for this invention are: U.S. Pat. Nos. 3,107,056; 3,713,584; 3,724,757; 3,854,664; 4,272,024; 4,353,507; 4,568,024; and 4,625,914.

BACKGROUND OF THE INVENTION

The present invention relates to rotary gear driven units having gear components. In my prior referenced patent application Ser. No. 932,470, I discussed the need to maintain a continuous bias on the reversing transmission's gear cage which alternately shifts a pair of terminal gears carried on a gear cage assembly into and out of engagement with an output shaft ring gear during the period that a reversing toggle is being moved over its reversing over center position. Maintaining a bias on the driving terminal gear insures that it will not become disengaged during stopping or starting of the drive.

In my referenced U.S. Pat. No. 4,955,542, a transmission concept is also disclosed for maintaining driving engagement of a reversing gear cage until reliable reversing action has occurred.

In my referenced U.S. Pat. No. 4,901,924, I discussed the importance of being able to set the arc of oscillation at any position of the nozzle and gear drive output shaft without first having to pre-position the gear drive's output shaft in order to move one of the arc of oscillation contact members closer to the other for a reduced arc of oscillation; and disclosed several reversing transmission configurations for gear driven sprinklers which provided for the sprinkler nozzle arc of oscillation to be restored to the proper arc if forced out of position by improper manual manipulation.

SUMMARY OF THE INVENTION

In the invention, the reversing mechanism has been simplified by incorporating the function of several parts into a single wire spring form which serves to provide an over-center driving engagement bias on a shiftable gear cage assembly which includes alternately engageable driving terminal gears with an output shaft ring gear as well as provide an over center carry function once the shiftable gear cage assembly has been driven out of engagement in one of its driving directions by one of the arc of oscillation control contact members. The wire is configured to serve as a reversing actuation arm, or member, for the reversing mechanism replacing the toggle member of the referenced patents.

The force of the reversing actuation arm spring must be sufficient once one of the gear cage assembly's driving terminal gears has been disengaged to over power the remaining gear cage assembly over-center engaging bias and provide sufficient travel to carry the gear cage assembly over center at which time the gear cage assembly over-center engaging bias is applied in the other direction now moving the opposite gear cage assembly terminal driving gear into engagement with the output shaft gear causing the output shaft driving action to be reversed.

Stiffening posts are provided on each side of the reversing wire actuation member in its actuated direction to stiffen it in either reversing actuation direction by shortening the bending length once the wire actuation member is deflected by the action of an arc control contact member in either direction and contacts the stiffening post. The stiffening posts are displaced from the wire actuation member sufficiently and the length is such as to engage the wire actuation member only after it has been deflected a sufficient distance to be able to move the gear cage assembly over center once the gear cage assembly has been driven out of engagement with the output shaft gear by the action of an arc control contact member against the now stiffened wire actuation member.

The spring rate of the wire actuation member must be such that the deflection of the wire actuation member is sufficient to carry the gear cage over center prior to the spring force resulting from the deflection of the wire actuation member over powering the gear cage assembly engaging bias.

Once a gear cage assembly terminal driving gear has been moved out of engagement with the output shaft gear the gear cage over-center spring has been moved closer to its neutral position so that at this position it can more easily be over powered by the deflected wire actuation member and carried over center to reverse its bias and move the gear cage assembly to engage its opposite direction driving terminal gear.

The wire actuation member stiffening posts provide the necessary stiffness for the wire actuation member once it is contacted by the wire actuation member to be sure that at a known deflection a gear cage terminal gear is moved out of driving engagement with the output shaft gear now causing the reversing action to be carried through by the action of the deflected wire actuation member to an over center position permitting the driving engagement over-center bias to complete the reversal, placing the other gear cage terminal gear into driving engagement with the output shaft gear.

An additional feature shown is an arc set contact member with a sloped back surface which can be rotated for a setting for 360° operation by having its sloped back surface overlap the other narrower arc set contact member contact surface to deflect the reversing actuation arm wire out of position to the outside to prevent its operation in a shifting direction of the gear cage which allows the gear cage to remain in one driving position and the output shaft to be continuously driven 360° in one direction.

An alternate spring configuration for providing the over center carry function is also shown where the over center carry action for the gear cage reversal is provided by a spring or springs carried on a separate shifting arm which is mounted adjacent to the reversing gear cage.

An additional alternate configuration for providing the over center carry function is shown with a stiff shaped gear cage actuation arm which is moveably mounted and biased to a given position on the gear cage to provide the over center carry function and with a shaped shaft to provide for setting the oscillating drive for a full 360° rotation in one direction. In addition these configurations allow for the transmission to reposition its output shaft to the proper arc of oscillation should it be manually forced out of its operating arc of oscillation.

A configuration is also disclosed where the over-center carry action is provided by movable and position biased arc control contact members against a rigid shiftable member actuation arm.

It is an object of the invention to provide a simplified reversing gear drive mechanism for ease of assembly and reduced number of parts and provides for maintaining a driving engagement bias on the reversing gear cage assembly during driving by either of its two alternately driving terminal gears, or devices, carried on the gear cage assembly, with an output shaft drive gear.

It is a further object of this invention to provide a simplified gear driven transmission with an adjustable arc of oscillation to include adjustment all the way to a continuous full circle rotational output.

A further object of the invention is to show a configuration with a separate shifting arm which carries a biasing means for carrying the gear cage assembly over its reversing center position once one of its driving terminal gears has been driven out of engagement by the action of an arc control contact against the shifting arm which operates reliably with minimum manufacturing tolerances, allows for greater gear cage arcute travel and provides great ease of assembly over prior art.

Another object of the invention is to provide a configuration where a moldable shaped part may be easily manufactured for the reversing actuation arm and movably mounted and biased to a desired position on the reversing gear cage.

It is a further object of the invention to provide a reversing actuation spring whose spring rate is such that the deflection is sufficient to carry the gear cage over center prior to the force generated by its deflection over powering the gear cage engaging bias. The spring rate is step changed in some configuration to be great enough once an adequate deflection is obtained to carry the gear cage over center, that the resulting force can over power the gear cage engaging bias.

Still another object is to provide a configuration where the arc control contact members are movable and position biased to provide for over center carry of the gear cage, or shiftable reversing member, for proper reversing action when acting directly on a rigid reversing gear cage actuation arm and configured to also provide for recovery of proper arc of oscillation operation of the oscillating sprinkler if forced out of its proper arc of oscillation. It is also configured to allow setting for full 360° continuous rotation.

BRIEF DESCRIPTION OF DRAWINGS

FIG. 11 is a side elevation view looking in along line 11—11 of FIG. 13 showing a configuration where the reversing actuation wire of FIG. 1 and FIG. 5 has been replaced by a moldable shaped stiff part that is angularly movably mounted and biased to an upward position on the top surface of the reversing gear cage bottom plate. The gear cage assembly driving engagement over-center bias spring for this configuration is as shown and explained in FIGS. 8, 9, and 10.

FIG. 11A shows the reversing actuation arm deflected against the biasing vertical alignment force of its rubber mounting insert.

FIG. 15 is a fragmentary side elevation view looking generally along line 15—15 of FIG. 14 with the output driving member removed showing the rigid actuation arm of the reversing gear cage being contacted by a deflected arc control contact member as well as the position and a partial view of the gear cage over-center biasing ribbon spring positioned below the gear cage bottom plate.

FIG. 16 is a fragmentary side elevation view also looking generally along line 15—15 of FIG. 14 but with the setable arc control contact member moved to allow for 360° driving rotation by biasing the arc control contact wire deflected out of its line of action with the rigid gear cage actuation arm. The other wire arc control contact member is also shown in its bending recess.

BEST MODE FOR CARRYING OUT THE INVENTION

Figure 1:
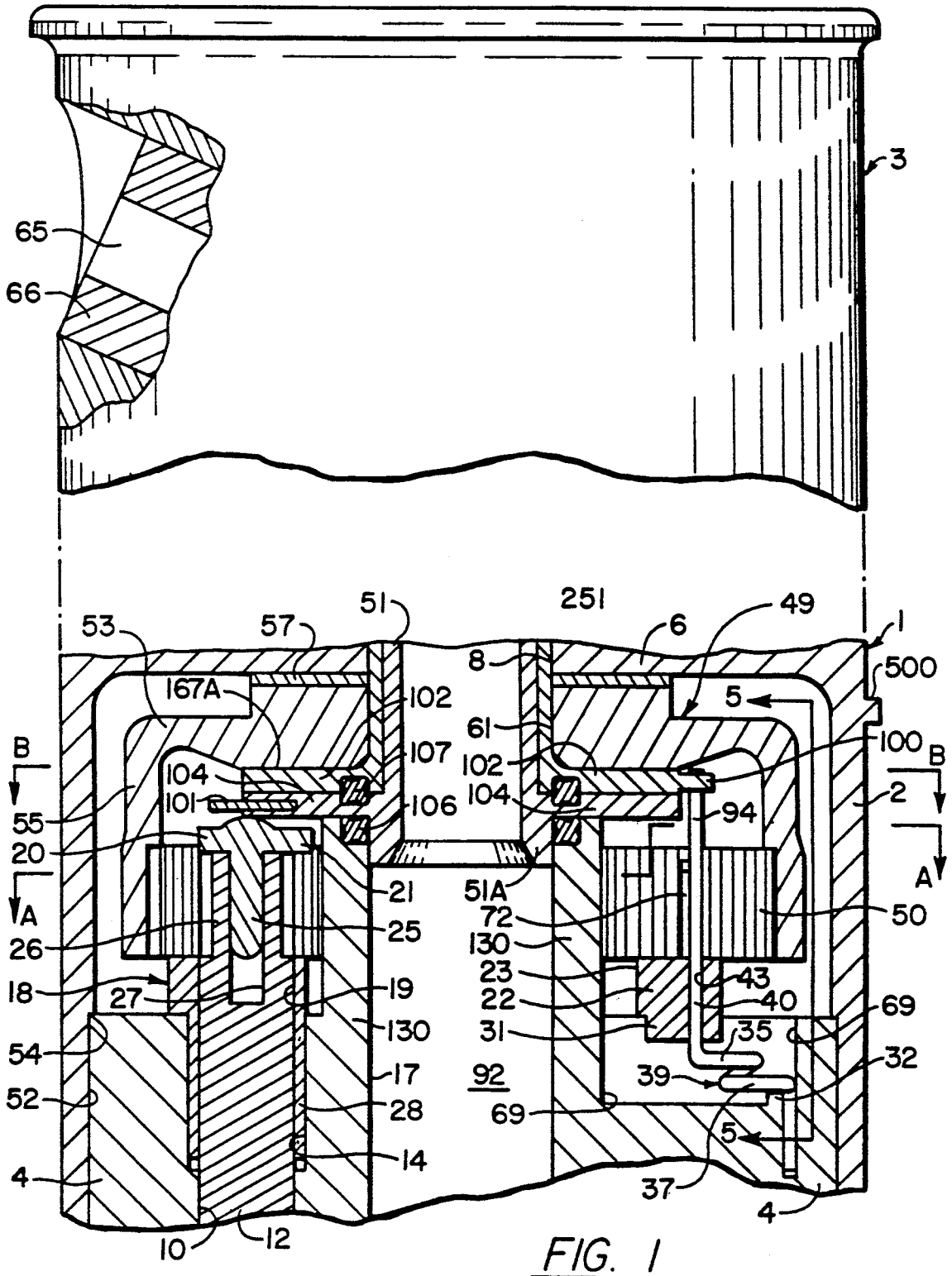
FIG. 1 is a fragmentary side elevational view of a sprinkler showing the upper rotating nozzle and reversing drive in section, with the gear cage assembly shown just disengaged from its clockwise position before being carried over center counterclockwise.

Referring to FIG. 1 of the drawings, a sprinkler device 1 is shown having a cylindrical housing 2 positioned over and fixed to a base member 4. Cylindrical housing 2 has an integral mid-flange 6 having a center opening 8 for a purpose to be hereinafter described. The end of cylindrical housing 2 over base member 4 has a circumference of an increased inner diameter 52 forming an annular step 54. Base member 4 is positioned in the increased diameter 52 of cylindrical housing 2 against the annular step 54.

Base member 4 has an opening 10 therethrough positioned to one side for receiving a rotary input shaft 12. Rotary input shaft 12 can be driven by a fluid turbine, which is enclosed in the lower part of housing 2.

Figure 2:
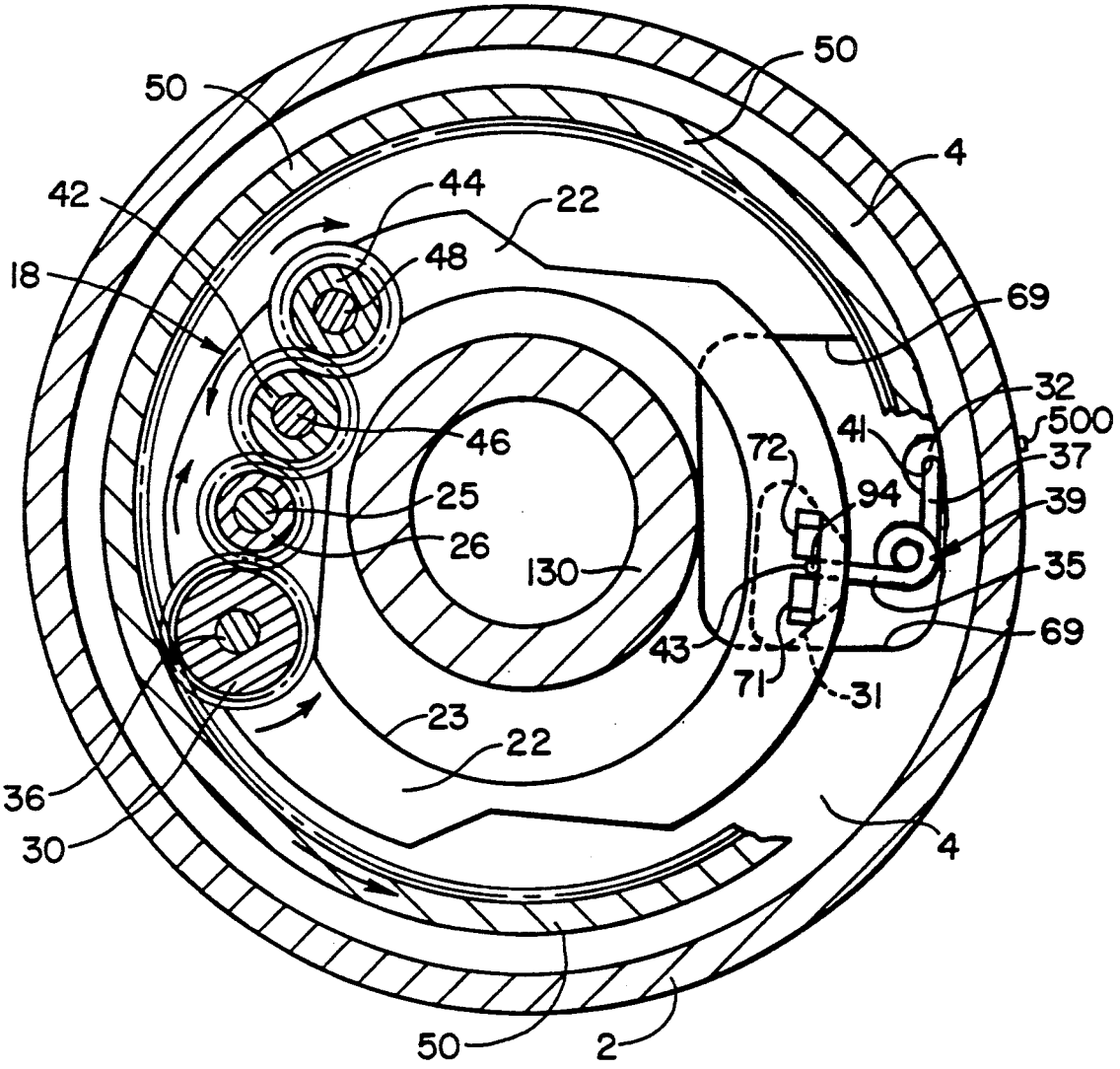
FIG. 2 is a transverse sectional view taken on line A—A of FIG. 1 showing the gear cage assembly in its fully clockwise position for driving the output ring gear for counterclockwise rotation. The reversing actuation arm wire is shown in its normal undeflected position between its two deflection stiffening posts.
Figure 3:
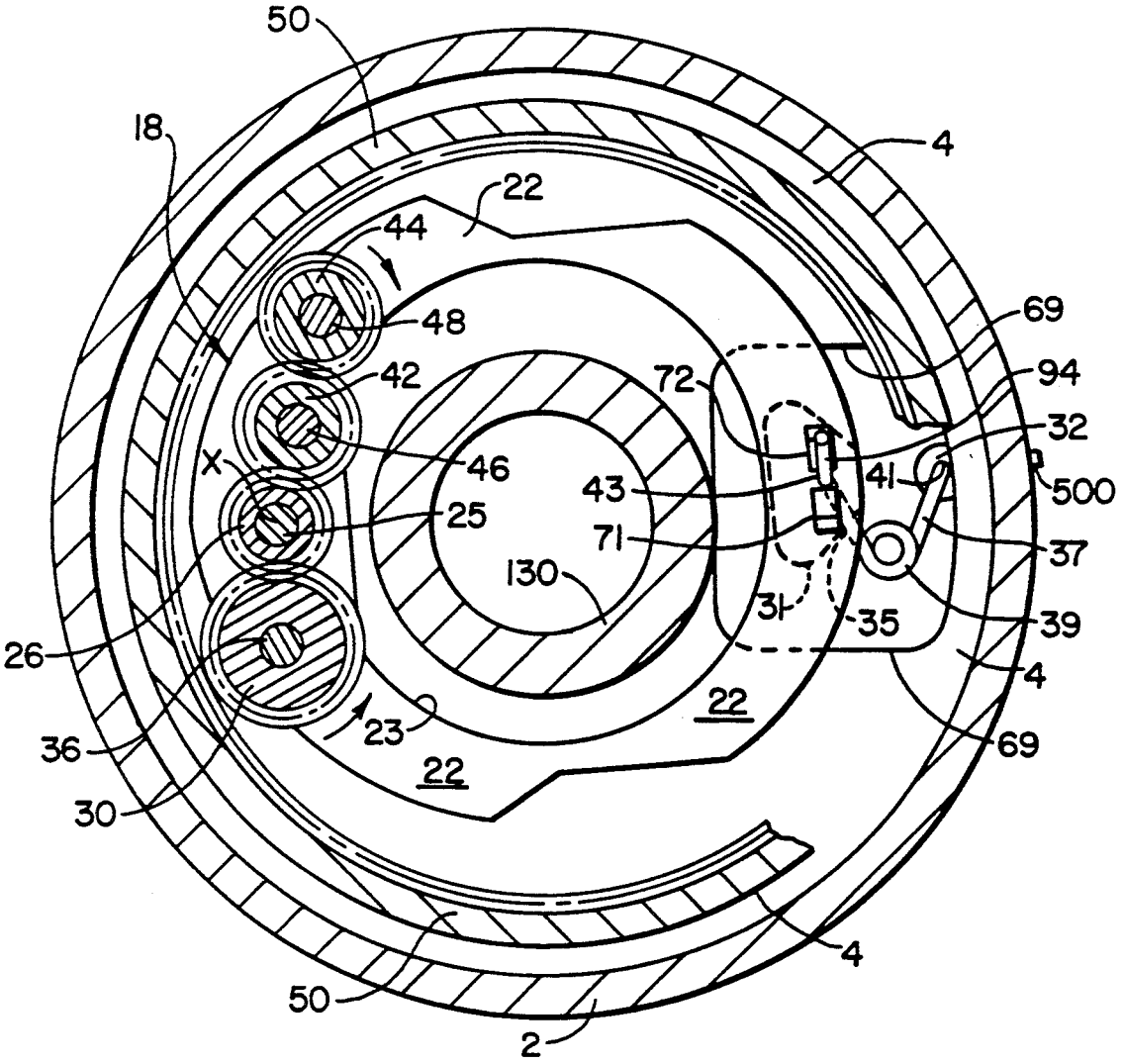
FIG. 3 is a sectional view similar to FIG. 2 taken along line A—A of FIG. 1 but with the gear cage assembly having been moved just out of driving engagement on its clockwise side of its reversing center and its reversing actuation arm wire shown deflected to contact the stiffening post on the counterclockwise side of the gear cage assembly center by the action of the upper arc set contact member.
Figure 4:
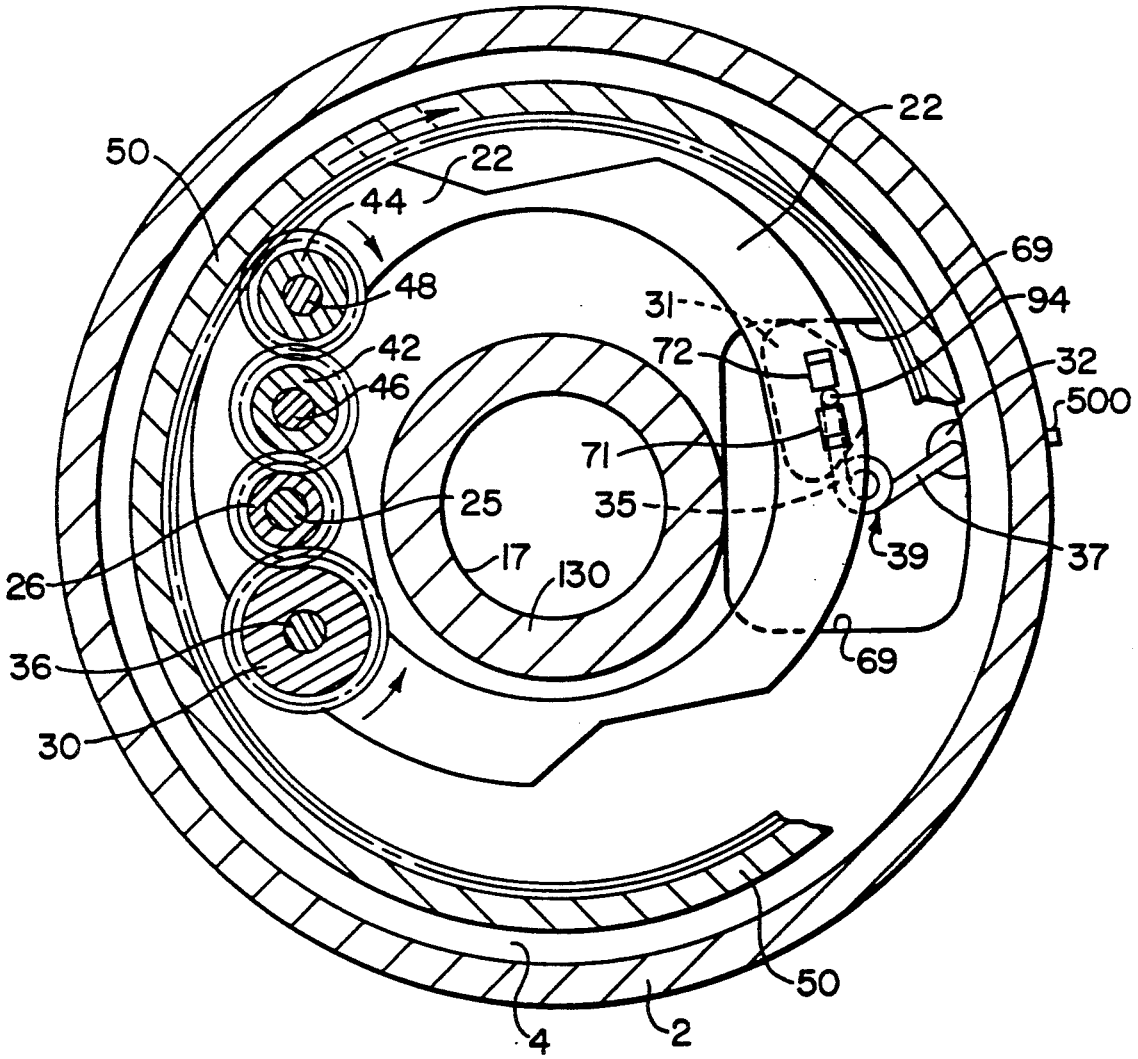
FIG. 4 is a sectional view similar to FIG. 2 taken on line A—A of FIG. 1 but with the gear cage assembly shown in its fully counterclockwise position for driving the output ring gear for clockwise rotation. The reversing actuation arm wire is shown in the normal undeflected position again between its two deflection stiffening posts.
Figure 5:
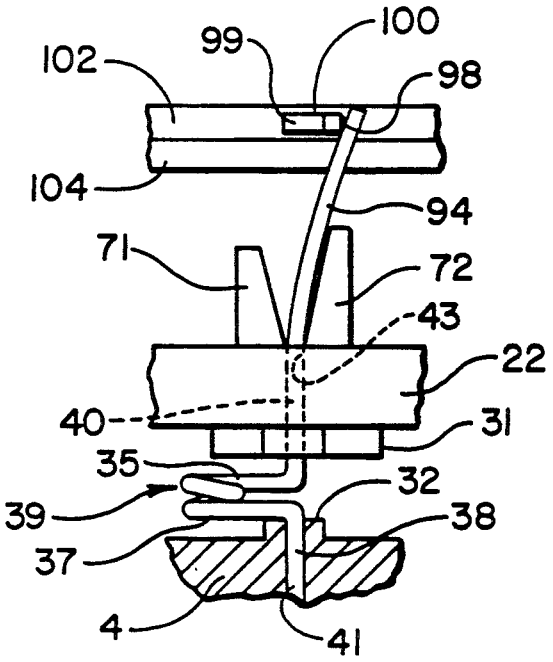
FIG. 5 is a side elevation view looking generally along line 5—5 of FIG. 1 with the output driving member removed, showing the reversing gear cage actuation arm wire and stiffening posts extending upwardly from the top surface of the gear cage bottom plate as well as the position of the integral gear cage over-center biasing hair pin spring positioned below the gear cage bottom plate as shown in FIG. 3.

A reversing gear cage assembly, or shiftable drive assembly, 18 is positioned within said cylindrical housing 2 adjacent said base member 4 and the reversing gear cage assembly 18 is formed having a top plate 20 and bottom plate 22 with cooperating center openings 21 and 23, respectively. The bottom plate 22 has an opening 19 therein to receive the rotary input shaft 12, the upper end of which is formed as a spur gear 26. Spur gear 26 is shown without teeth in FIGS. 2, 3, and 4, showing the pitch circle. A cylindrical shaft 28 extends downwardly from the bottom of plate 22 around opening 19 and extends into the enlarged upper part 14 of the opening 10 to provide for pivotal movement of the reversing gear cage assembly 18 while the cylindrical shaft 28 properly positions the input shaft 12 and spur gear 26. An integral shaft 25 extends downwardly from the bottom of top plate 20 to engage a cylindrical opening 27 extending downwardly from the top of input shaft 12 through the center line of the spur gear 26.

As shown in FIGS. 2, 3, and 4, a gear 30 is mounted on an integral shaft 36, extending downwardly from top plate 20 of the reversing gear cage assembly 18 in a counterclockwise direction from the integral shaft 25. Gear 30 is shown without teeth, showing the pitch circles. Integral shaft 36 is positioned so that gear 30 will engage the spur gear 26 and is positioned so that gear 30 extends outwardly over the edges of top plate 20 and bottom plate 22 so that it can drivingly engage an output ring gear 50, encircling the reversing gear cage assembly 18 between the top plate 20 and the bottom plate 22. Ring gear 50 is shown without internal teeth, showing the pitch circle. Output ring gear 50 is formed as a part of output driving member 49. Output driving member 49 will be hereinafter discussed as to its structure and use.

The output driving member 49 consists of ring gear 50 surrounding the reversing gear cage assembly 18, a cylindrical member 55 extending upwardly from ring gear 50 connects to an annular radial flange member, or disc, 53 with a center opening 61 through which output shafts 51 and 251 extend upwardly.

Two gears 42 and 44 are mounted on integral shafts 46 and 48 extending downwardly from top plate 20 of the reversing gear cage assembly 18 and they extend in a clockwise direction from the integral shaft 25. Gears 42 and 44 are shown without teeth, showing the pitch circles. Integral shaft 46 is positioned so that gear 42 will engage the spur gear 26 and shaft 48 is positioned so that gear 44 engages gear 42 and extends outwardly over the edges of top plate 20 and bottom plate 22 so that it can drivingly engage said output ring gear 50.

Integral shafts 36, 46, and 48 of top plate 20 extend into matched openings in bottom plate 22 and have a snap engagement at their ends with said openings to fix said top plate 20 and bottom plate 22 of the reversing gear cage assembly 18 together.

The subject matter of U.S. patent application Ser. No. 932,470, U.S. Pat. No. 4,901,924, and U.S. Pat. No. 4,955,542 is included herein by reference as if it were fully set forth.

Hollow inner output shaft 51 and concentric hollow outer output and arc set shaft 251 are separate from the output driving member 49. The upper surface of annular disc 53 has a raised portion at its center on which a thrust washer 57 is placed to engage the inner surface of integral mid-flange 6. Inner output shaft 51 and outer concentric output and arc set shaft 251 extend through center opening 61 in annular radial flange member 53, an aligned opening in thrust washer 57, and opening 8 in integral mid-flange 6 of housing 2 to the exterior thereof, said output shaft 51 projecting out of said output and arc set shaft 251.

The bottom of outer output and arc set shaft 251 has a radial flange 102 extending outwardly therefrom and positioned to have its upper surface contact the under surface of annular radial flange member 53 adjacent to the outer output and arc set shaft 251. The bottom of inner output shaft 51 has a radial flange 104 extending outwardly therefrom and positioned to have its upper surface contact the under surface of radial flange 102. A lightly serrated friction area 167A is formed between radial flange 102 and under surface of radial flange 53 of output driving member 49, forming a slip clutch drive. Fluid pressure tends to load these flanges together during pressurized operation of the sprinkler and apply force on area 167A to connect them to ring gear 50 to drive shafts 51 and 251.

The under surface of radial flange 104 has a short hollow shaft 51A extending downwardly in alignment with the inner output shaft 51 which fits into cylindrical member 130 of base member 4 with the adjacent portion of radial flange 104 facing the top of the cylindrical member 130.

A sealing means 106 is placed in a groove in the upper inner diameter of cylindrical member 130 to seal with the short hollow shaft 51A and radial flange 104. A sealing means 107 is placed in facing matching grooves of mating surfaces of radial flange 102 and radial flange 104.

The radial flange 102 has a radially projecting arc control contact member 100 with a flat actuating side 98 and a curved or sloped side 99, and the radial flange 104 has a radially projecting arc control contact member 101 which is shown as a narrow stiff member having a flat actuating side 97. Said arc control contact members 100 and 101 determining the angle of oscillation.

A nozzle assembly 3 is connected to the top ends of inner output shaft 51 and outer output and arc set shaft 251 for rotation. Means are provided for rotating the inner and outer output shafts relative to each other to allow setting the relative location of each of arc control contact members 100 and 101 for setting the desired arc of oscillation of the nozzle assembly. Nozzle assemblies 3 are shown driven by an inner output shaft and outer output and arc set shaft, such as shaft 51 and shaft 251, in U.S. Pat. No. 4,901,924.

In operation the straight surfaces of arc control contact members 100 and 101 when contacting the reversing gear cage actuation arm wire 94 cause the gear cage assembly to be shifted to its reversing position as described. When the sloped surface of contact member 100 contacts the actuation arm wire 94 it is deflected outwardly as described and no reversing action occurs which has the effect of placing the actuation arm wire 94 on the other side of arc control contact member 100 and between the straight actuation surfaces 98 and 97 of arc control contact members 100 and 101, respectively, should the actuation arm wire 94 ever be displaced out of this arc control position by the manually forced rotation of the nozzle assembly and the resulting rotation of the output shafts 51 and 251 as allowed by clutching means 167A between the output shafts and the output driving member 49.

A gear cage reversing actuation arm wire 94 extends upwardly from the upper surface of the bottom plate 22. This actuation arm wire 94, in combination with two actuation stiffening posts 71 and 72 mounted in line with said actuation arm wire 94, in front and back thereof, also extends upwardly from the top surface of the bottom plate 22. The stiffening posts 71 and 72 are provided with slanted surfaces to provide some deflection of the reversing actuation arm wire 94 before it contacts the stiffening posts, providing gear cage assembly shifting about the center of opening 10, cylindrical shaft 28 and spur gear 26, as reversing gear cage assembly 18 is moved between its clockwise driving position and counterclockwise driving position.

It can be seen that when the reversing gear cage assembly 18 is positioned clockwise around input shaft 12, as shown in FIG. 2, the gear 30 is engaging the ring gear 50. With the rotary input shaft 12 being driven clockwise, the drive gear 30 is rotated counterclockwise, imparting a counterclockwise rotation to output ring gear 50. When the reversing gear cage assembly 18 is positioned counterclockwise around input shaft 12, as shown in FIG. 4, the gear 44 is engaging the ring gear 50. With the rotary input shaft 12 being driven clockwise, the one idler gear 42 will rotate the drive gear 44 clockwise, imparting a clockwise rotation to output ring gear 50.

To bias the reversing gear cage assembly 18 in a clockwise direction to have gear 30 engage ring gear 50, or bias the reversing gear cage assembly 18 in a counterclockwise direction to have gear 44 engage ring gear 50, an over-center biasing spring 39 is integrally formed with the reversing actuation arm wire 94 having a hair pin spring shape whose one free arm 37 turns 90° downwardly at 38 and is inserted into a cooperating hole 41 in a recess 69 in base member 4. The other arm 35 of the hair pin spring wire turns 90° upwardly at 40 and passes through a cooperating hole 43 in the lower surface of the lower gear cage plate 22 and continues through and upward to be the reversing actuation arm wire 94.

The reversing gear cage assembly 18 has a downwardly projecting member 31 located on the bottom of bottom plate 22 of the reversing gear cage 18 and extends into recess 69 formed in the top of base member 4. Downwardly projecting member 31 is positioned below and centered on the actuation arm wire stiffening posts 71 and 72 protruding upwardly from the top side of bottom plate 22. An upwardly projecting member 32 is located at a position on the outer wall of recess 69.

The wire hole 43 for arm 35 of over-center spring 39 in bottom plate 22 and the wire hole 41 for arm 37 of over-center spring 39 in the base 4 are on a radial line through the center X of cylindrical shaft 28 of the bottom plate 22 with the gear cage in its neutral position (neither terminal gear 30 or 44 engaging ring gear 50). The over-center spring means 39 extends between spring wire hole 43 opening out of the downwardly projecting member 31 of the bottom plate 22 of gear cage assembly 18 and the spring wire hole 41 opening out of the upwardly projecting member 32 at the outer wall of recess 69. Over center spring means 39 is formed as a 1½ to 2½ turn closed coil hair pin shaped wire form of (i.e. 0.014 to 0.016 diameter) spring steel wire. Each end of the thus formed hair pin spring has the wire ends bent 90° to enter spring seat hole 43 in the bottom plate 22 and the spring seat hole 41 in base member 4. The biasing force of the over-center spring means 39 is made greater than the actuation arm wire 94 shifting bias force created when the actuation arm wire 94 is being deflected sufficiently to contact the actuation wire stiffening posts 71 or 72 so that the over-center spring means 39 will maintain the driving gear 30 or 44 of reversing gear cage 18 in engagement with output ring gear 50 until the actuation arm wire 94 has been deflected a known distance and then as it is moved further, clockwise or counterclockwise, striking a stiffening post 71 or 72 the gear cage driving terminal gear 30 or 44 is moved out of driving engagement with output ring gear 50 to the position shown in FIG. 3 by arc control contact member 100. At this point the biasing force produced by the deflected actuation arm wire 94 is able to now over power any remaining clockwise bias of the gear cage over-center biasing spring 39 since it is close to its neutral (ends aligned) position and carry the gear cage assembly 18 over the neutral center position of biasing spring 39 and then aid spring 39 in continuing to move the gear cage counterclockwise until actuation wire 94 has returned to its vertical neutral position at which point gear cage over-center biasing spring 39 is substantially over its center neutral position and now continues to move the gear cage assembly 18 to its fully counterclockwise position fully engaging terminal driving gear 44 for now driving output ring gear 50 in a clockwise direction.

With the output ring gear 50 now being rotated clockwise the process is reversed when arc control contact 101 is rotated around clockwise to contact the gear cage actuation arm wire 94 from the other side and force it to deflect and then contact actuation wire stiffening post 71 causing the gear cage driving terminal gear 44 to be disengaged and the gear cage assembly 18 now moved clockwise by the force from the deflected actuation arm wire 94 returning back to its normal vertical position from having been deflected against stiffening post 71 and causing the gear cage assembly 18 to be moved over center in a clockwise direction causing the bias of over-center spring 39 to again bias and move the gear cage assembly 18 fully clockwise re-engaging driving terminal gear 30 with output ring gear 50 causing it to now be driven counterclockwise again.

This configuration will still function properly without the stiffening posts 71 and 72 on each side of the actuation arm wire 94 so long as the actuation arm wire 94 is flexible enough relative to the force necessary to overpower the gear cage assembly 18 biasing portion of the over-center spring 39 when it is in its driving position so that it is deflected a sufficient arcuate distance so that when it does overpower the engagement gear cage bias spring 39 action this deflection travel will carry the gear cage assembly 18 and its over-center biasing spring 39 over center to cause it to bias the gear cage assembly 18 into engagement for moving the output ring gear 50 in a reversed direction.

The actuation arm wire 94 must not be so flexible relative to the force necessary to cause the gear cage assembly driving gears 30 or 44 to be carried out of engagement that it is simply bent over and does not reliably carry the gear cage assembly 18 out of engagement for the desired reversing over-center action.

The biasing force of the hair pin shaped gear cage biasing spring can be adjusted by the free opening shape of the wire form and how many coils it has. The gear cage assembly 18 over-center biasing spring 39 is shown with two active coils.

The stiffening post thus causes the shifting action to occur at a definite point each time regardless of the torque on the gear drive.

Figure 6:
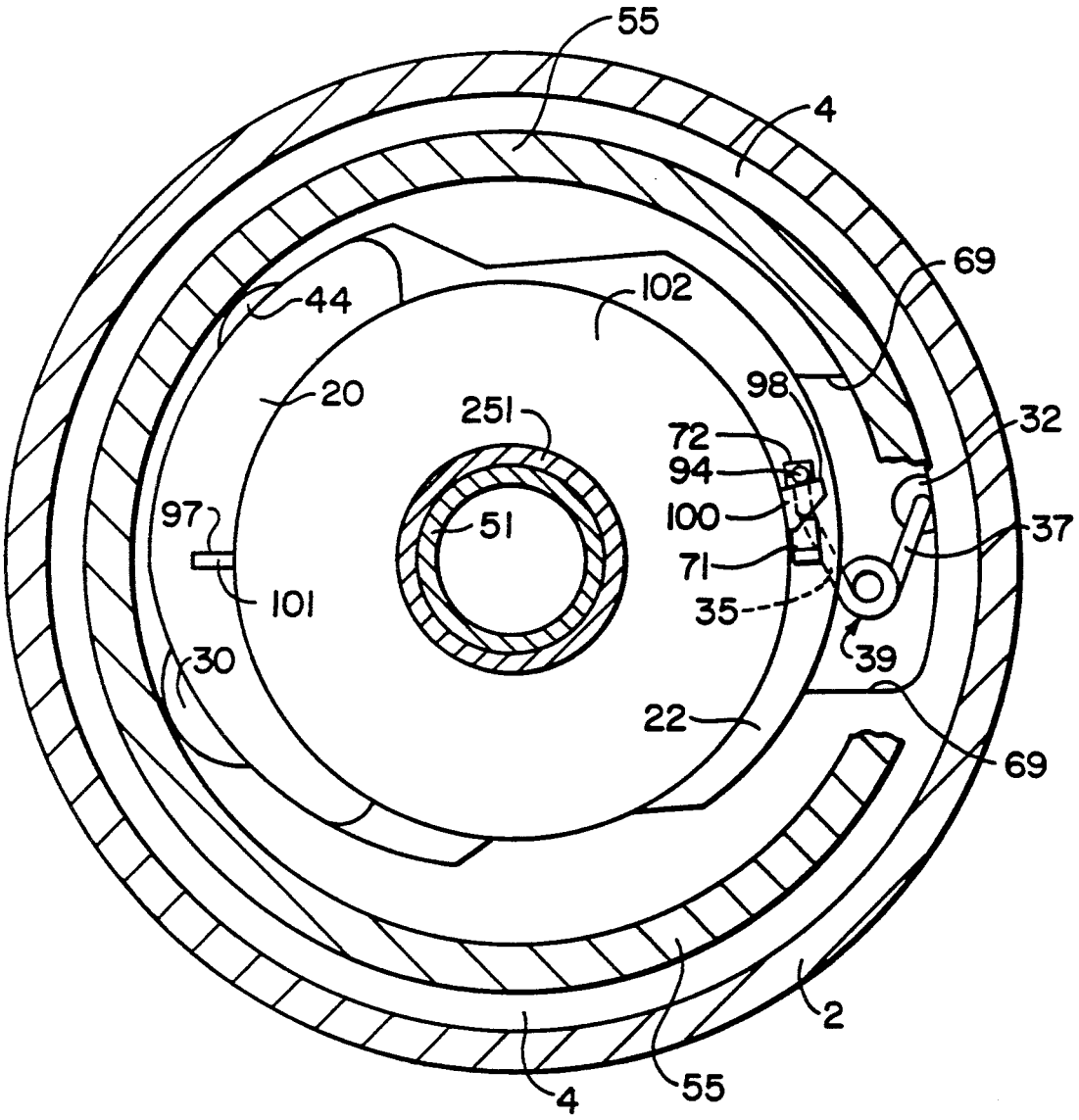
FIG. 6 is a transverse sectional view taken on line B—B, of FIG. 1 showing the contact members set for approximately a 180 degree arc of oscillation operation and with the setable upper arc set contact member contacting the reversing actuation arm wire having deflected it to contact its counterclockwise stiffening post and moved the gear cage assembly against its over-center biasing spring to the position shown in FIG. 3 of just having disengaged the driving terminal gear and the carry action of the deflected actuation arm wire ready to carry the gear cage assembly over center against the reduced bias at this position of the gear cage biasing spring.
Figure 7:
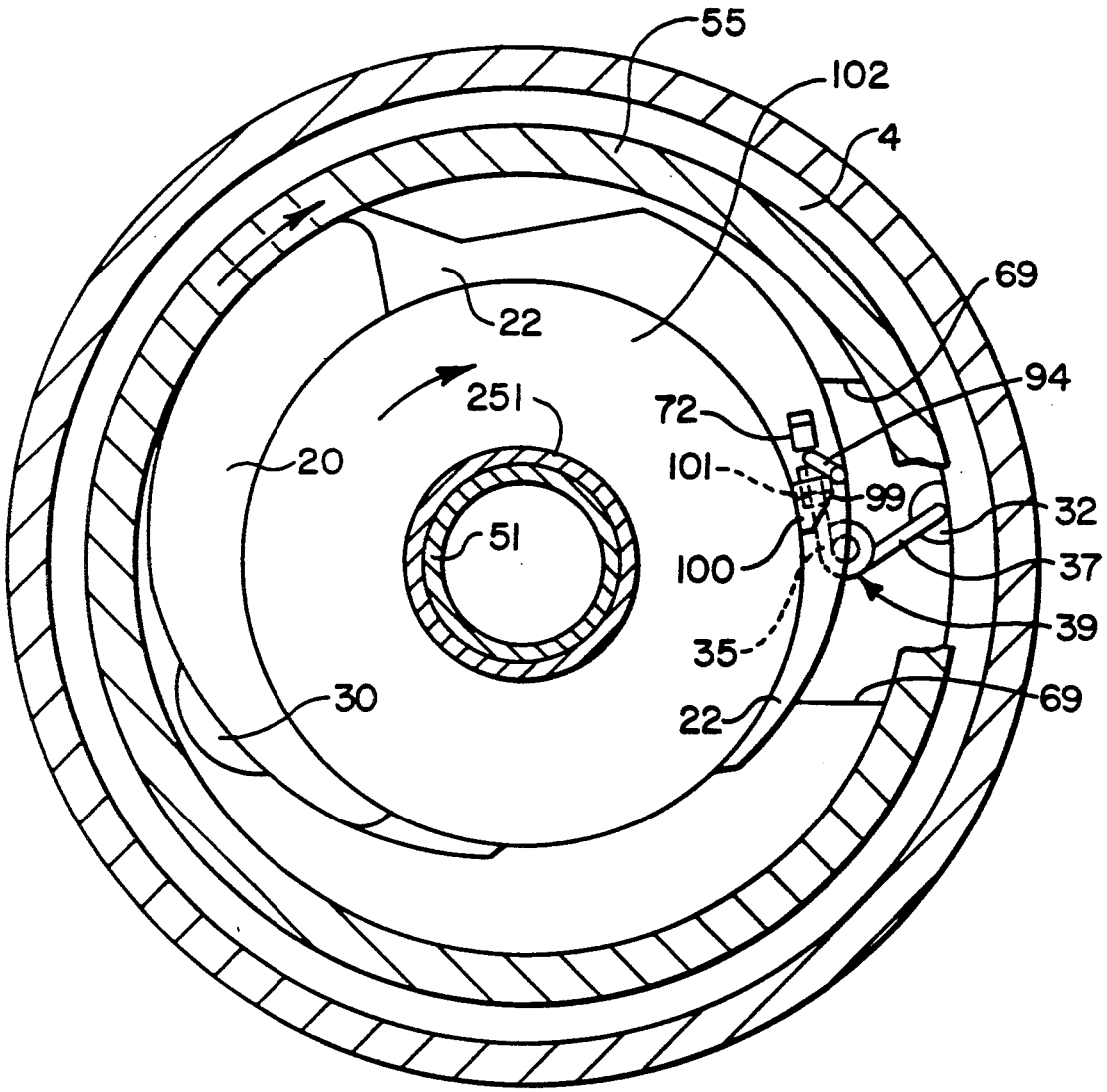
FIG. 7 is a transverse sectional view taken on line B—B of FIG. 1 showing the adjustable arc set contact member moved to overlap the fixed contact member for a continuous 360° rotation operation and with the two overlapping contact members shown contacting the actuation arm wire while rotating in a clockwise direction. The gear cage actuation arm wire is shown deflected outwardly by the sloped surface of the overlapping arc set contact member preventing it from contacting the clockwise gear cage stiffening post therefore preventing it from driving the gear cage out of its counter-clockwise position for driving the output ring gear clockwise.

In FIG. 7 the adjustable arc control contact member 100 is shown moved from its 180° arc of oscillation of FIG. 6 to overlap the fixed contact member 101 for a 360° continuous clockwise direction of rotation operation of the reversing gear drive.

The sloped back side 99 of the adjustable arc control contact member 100 which is overlapping the fixed contact member 101 when set for 360° movement is shown contacting the actuation arm wire 94 while rotating in a clockwise direction. This is not the normal contact direction for this arc control contact member 100 and its sloped back side 99 has cammed the actuation arm wire 94 outwardly of the overlapped arc control contact member 101 which would normally have contacted the actuation arm wire 94 from this direction of the rotation and also prevented the actuation arm wire 94 from contacting the clockwise gear cage stiffening post 71, thus preventing it from driving the gear cage assembly 18 out of its counterclockwise driving position for driving the output shaft ring gear 50 in a clockwise direction. Thus it will continue to drive the output ring gear 50 in a clockwise direction and this passing action of the arc control contact member for the 360° overlapping setting will continue to allow it to not be reversed for each rotation.

The outward camming action of the sloped back side 99 of the adjustable arc control contact member 100 will also act to reposition the gear cage actuation arm wire 94 correctly back between the fixed arc control contact member 101 surface 97 for the desired set arc of oscillation should the actuation arm wire 94 get forced out of position by manual forced rotation of the nozzle assembly or by the manual arc setting action of reducing the angular position of the movable arc control contact member 100 relative to the fixed arc control contact member 101 and during this movement having forced the contact member 100 past the actuation arm wire 94 in which case it would now be positioned to be contacted by sloped surface 99 of the movable arc control contact member 100 and the flat surface 97 of the fixed contact member 101.

Figure 8:
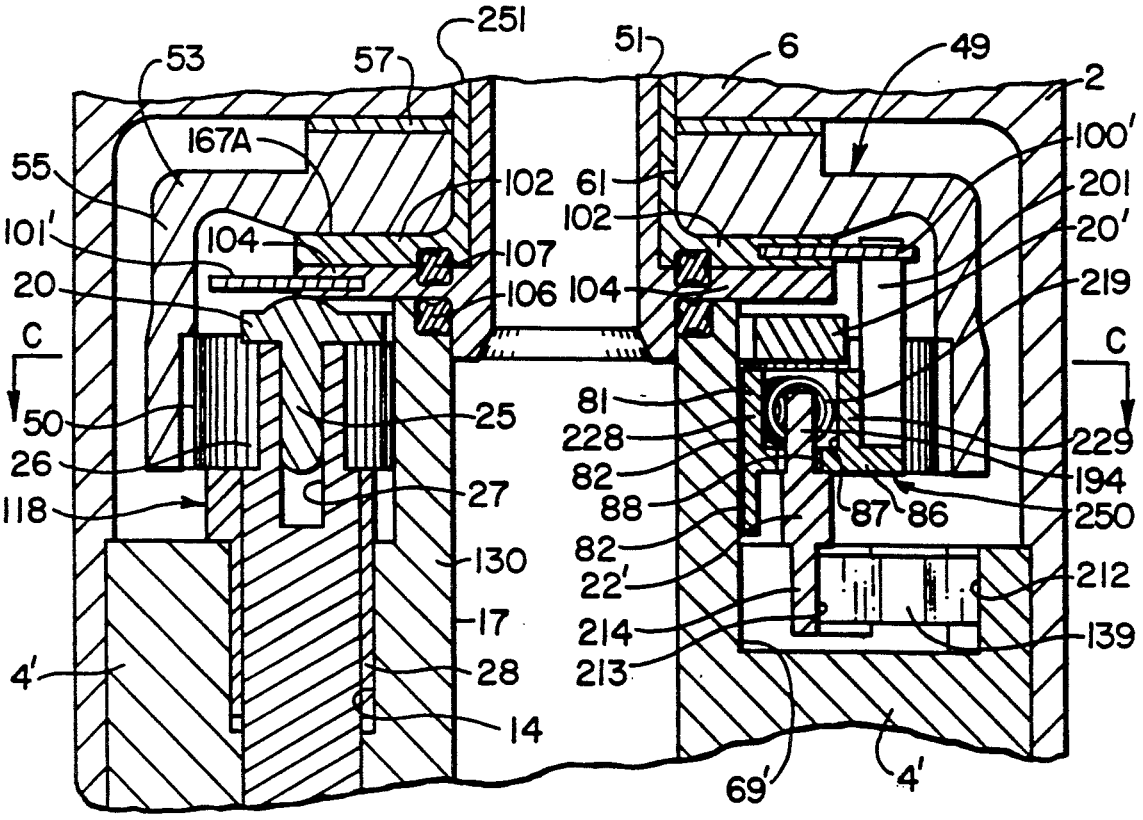
FIG. 8 is a fragmentary side elevation view of an alternate oscillating sprinkler transmission reversing drive in section with the gear cage assembly shown just disengaged from its clockwise position before being carried over center counterclockwise by a biasing spring carried by a shifting arm member.
Figure 9:
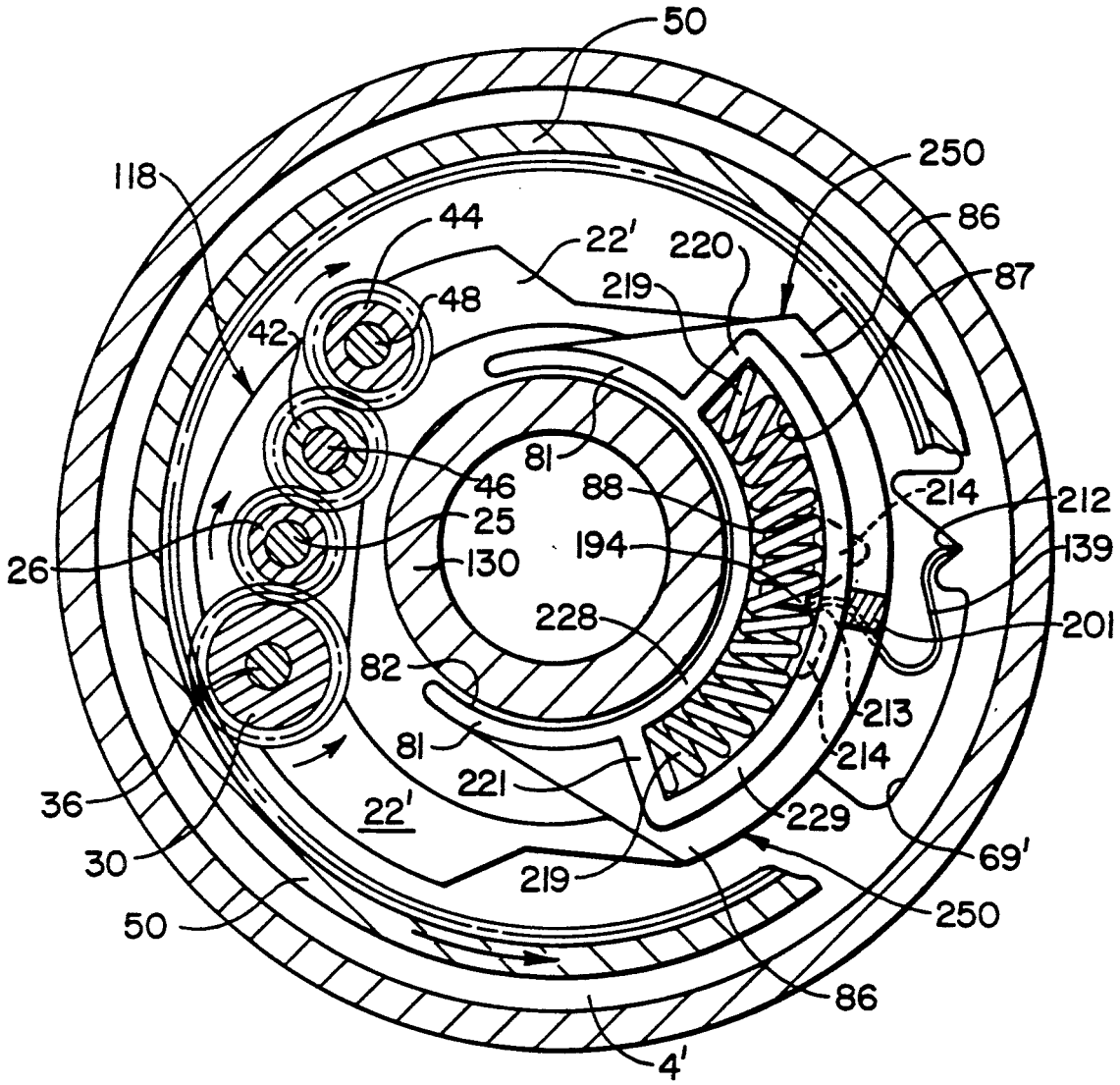
FIG. 9 is a transverse sectional view taken on line C—C of FIG. 8 showing the gear cage assembly in its fully clockwise position for driving the output ring gear for counterclockwise rotation. A C-shaped reversing shifting arm is shown with its carry spring centered prior to being moved by a reversing arc control contact member.
Figure 10:
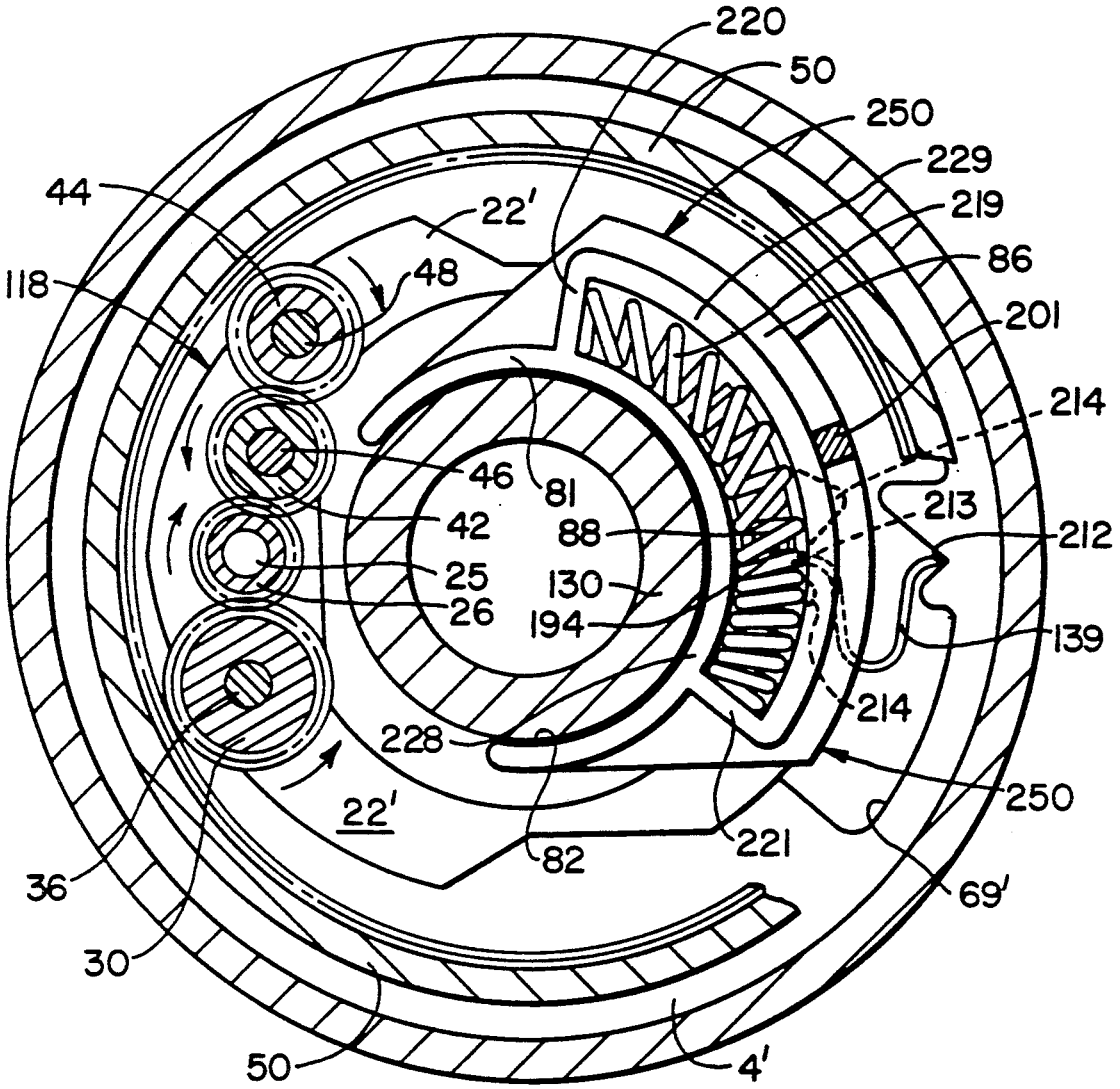
FIG. 10 is a transverse sectional view similar to FIG. 9 also taken along line C—C of FIG. 8 but with the gear cage having been moved just out of driving engagement on its clockwise side of its reversing center and with the carry spring carried by the C-shaped shift arm compressed and ready to carry the gear cage further counterclockwise over its reversing center.

Referring to the alternate configuration reversing transmission shown in FIGS. 8, 9 and 10, a C-shaped shifting arm device 250 has been added partially surrounding the center cylindrical member 130. The C-shaped shifting arm device 250 is formed with a C-shaped member 81 having an inner surface 82 extending upwardly and downwardly at the inner end of a flat radial arm 86 positioned for partial rotation around cylindrical member 130. An actuation arm 201 extends upwardly from the outer end of flat radial arm 86 of shifting arm device 250 for contact by radial arc control contact members 100' and 101' rotated by ring gear 50 to rotate the shifting arm device 250 in a counter-clockwise, or clockwise direction, respectively.

The shifting arm device 250 also has an arcuate recess 87 formed on the upper surface of flat radial arm 86 with an inside arcuate wall formed by the center section 228 of member 81 and an outer arcuate wall 229, with radial end walls 220 and 221. A continuous coil spring 219 is located in said arcuate recess 87. This coil spring 219 extends for the full length of the arcuate recess 87 and abuts each end. This arcuate recess 87 also has an arcuate opening 88 through its bottom surface. Arcuate opening 88 is provided to allow a gear cage actuation post 194 to extend upwardly therethrough from the top surface of the bottom plate 22' of gear cage assembly, or shiftable drive assembly, 118 and extend into the mid-portion of the single continuous coil spring 219 with the gear cage actuation post 194 simply extending into the center of the coil. The top plate 20' is formed annular in shape and extends over the top of the arcuate recess 87. The portion of top plate 20' passing over the arcuate recess 87 is made thicker (see FIG. 8) to provide a cover over the arcuate recess 87 to aid in holding the continuous coil spring 219 in place.

Also in this configuration, to maintain a biasing force on the reversing gear cage assembly 118 at all times to keep a driving gear 30 or 44 into engagement with ring gear 50, a gear cage projection 214 extends downwardly from the gear cage bottom plate 22' into a recess 69' formed in base member 4'.

Downwardly extending projection 214 is positioned below the gear cage actuation post 194, which extends upwardly from the top surface of the bottom plate 22'.

Gear cage projection 214 has a spring seat, or notch, 213 formed therein facing radially outwardly and recess 69' has a cooperating spring seat, or notch, 212 formed on its outer wall facing radially inwardly. With the gear cage assembly 118 in its neutral, or center, position, (see FIG. 10) spring seat 213 and spring seat 212 are located on a radial line through the center of the gear cage shaft 25 which is the center about which the gear cage assembly 118 moved during shifting.

Gear cage assembly 118 has an over-center spring means 139 extending between spring seat 213 on the projection 214 and spring seat 212 on the outer wall of recess 69'. Over-center spring means 139 is formed from ribbon-like spring material in this configuration, for example steel, and shaped with an intermediate arcuate portion bellshaped and oppositely directed straight end portions to engage the spring seats 212 and 213. Each end of the straight portions have serrations to grip the spring seat notches. Springs of this type are shown in applicant's referenced patents.

In FIG. 9 the gear cage assembly 118 is shown biased by over-center spring means 139, over its neutral, or center, position to its clockwise driving position with its terminal gear 30 engaging output ring gear 50 for driving it counterclockwise. The shifting arm device 250 is shown in a neutral position with its single continuous coil spring 219 centered with the gear cage actuation post 194. It should be noted that spring 219 is not mounted to function as an over-center spring. The shifting arm device 250 of this modification is not an over-center toggling device as disclosed in referenced U.S. patent application Ser. No. 932,470 filed Nov. 18, 1986. Shifting arm device 250 is moved over the center position of the gear cage assembly 118 by the actuation arm 201 while pre-loading coil spring 219 against actuation post 194 a given amount to have it move the gear cage assembly 118 over center when the driving gear engaged has become disengaged. This permits the over-center spring 139 to engage the other driving gear. The gear cage spring 139 is shown as an over-center configuration spring but the driving engagement bias for the shiftable drive assembly, or gear cage assembly, 118 on either side of its center position could take some other form, such as a spring loaded ball mounted on the housing which falls into one of two notches on the shiftable drive assembly on each side of its center position.

FIG. 10 shows the shifting arm device 250 having been driven counterclockwise by the actuation of arc control contact member 200 shown in FIG. 8 against its upwardly extending actuation arm 201. It is shown having pulled the gear cage assembly 118 counterclockwise out of driving engagement between terminal gear 30 and output ring gear 50 and with its clockwise portion of its single continuous coil spring 219 compressed to carry the gear cage assembly 118 and its over-center biasing spring 139 over center counterclockwise to achieve the reversing action with the gear cage assembly 118 moved to its fully counterclockwise position with its terminal driving gear 44 now engaging output ring gear 50, for now driving output ring gear 50 clockwise.

The single continuous coil spring 219 should have a spring rate such that when it is compressed in recess 87 a sufficient distance it develops a force to carry the gear cage assembly 118 the remaining distance to be over center before it has accumulated sufficient force to overpower the over-center biasing spring 139 and cause the gear cage assembly 118 to be moved out of driving engagement.

The gear cage assembly 118 may also be pulled out of driving engagement by the action of the slot ends of the lower arcuate opening 88 of the arcuate recess 87 against the gear cage actuation post 194. This would act like a lost motion connection between the shifting arm device 250 and the gear cage assembly 118 and provide a definite established amount of compression of the single continuous coil spring 219 at the time the gear cage driving terminal gear is pulled out of engagement rather than just depending upon the compression of spring 219 eventually overpowering the gear cage over-center biasing spring 139 and any torque factor that may exist under various loads.

Figure 12:
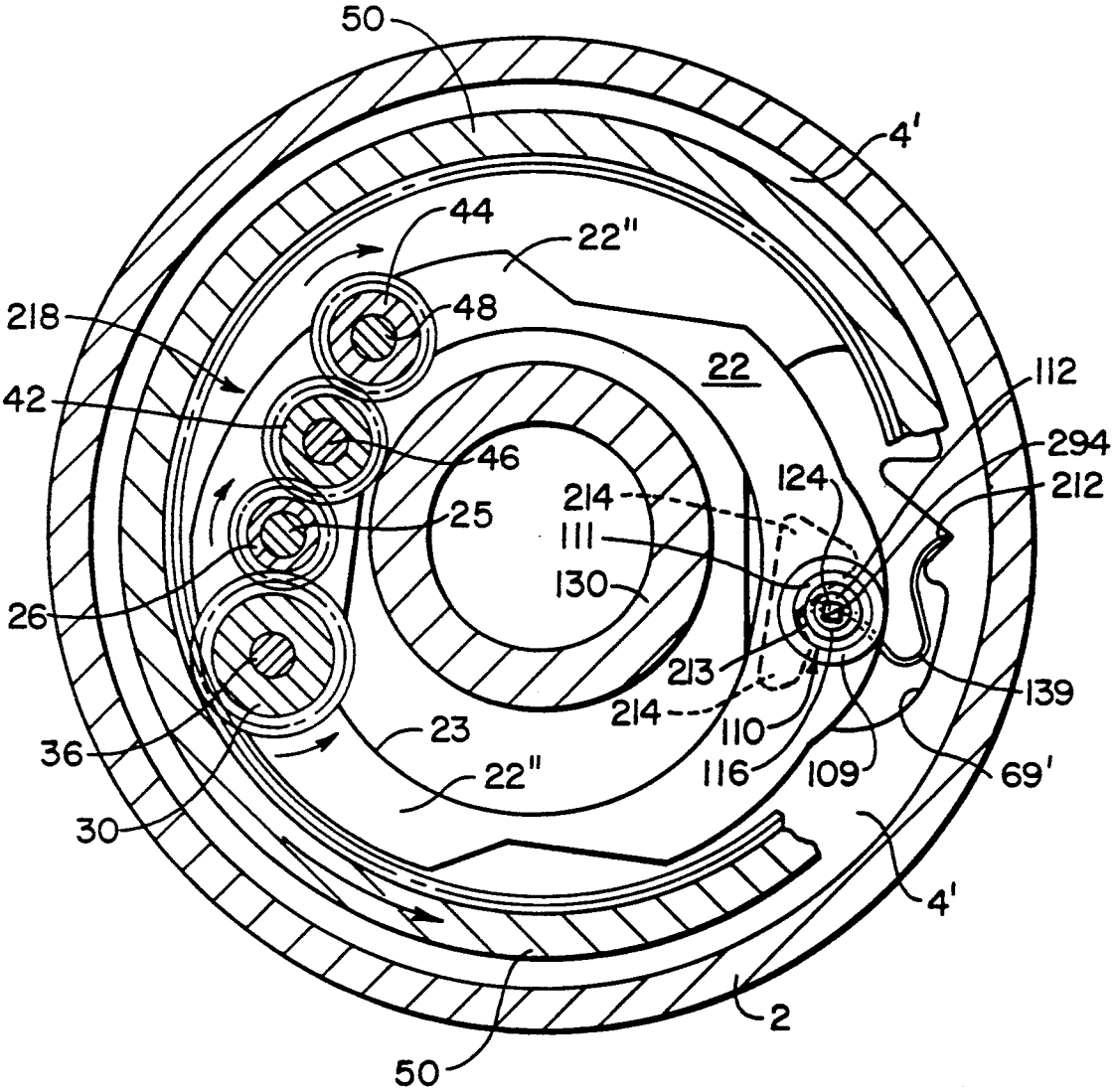
FIG. 12 is a transverse sectional view taken on line A—A of FIG. 1 with the modification of FIG. 11 incorporated showing the gear cage assembly in its fully clockwise position for driving the output ring gear for counter clockwise rotation. The shaped movable reversing actuation arm is shown in its centered vertical neutral biased position on the top surface of the gear cage bottom plate.
Figure 13:
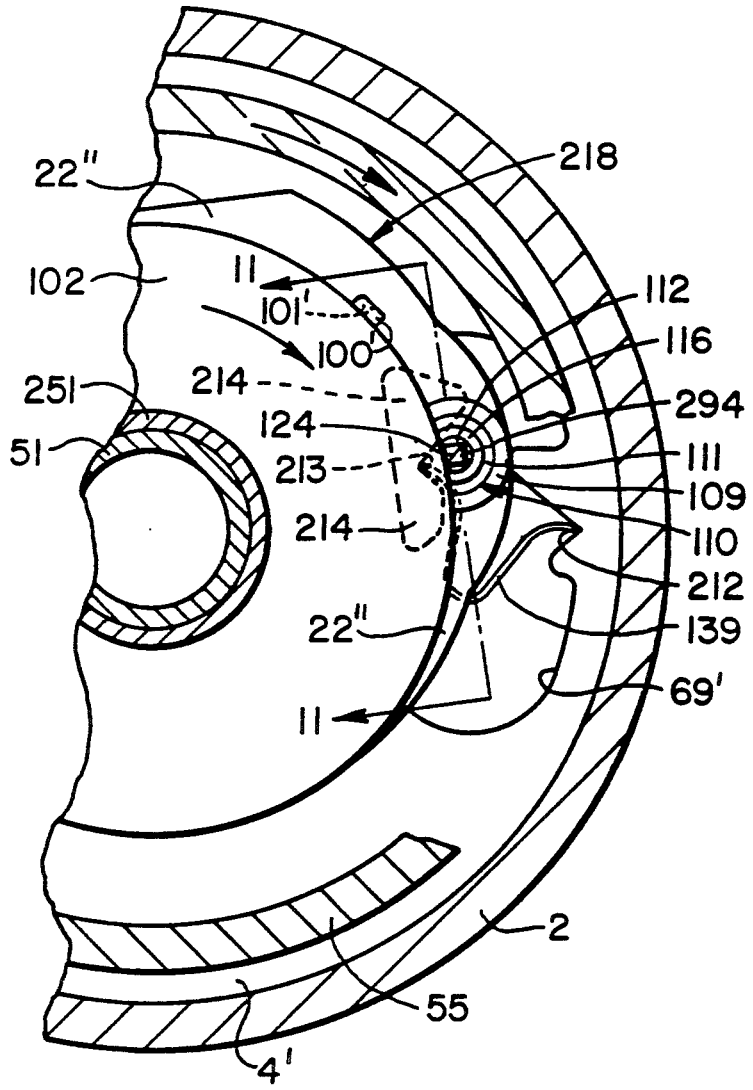
FIG. 13 is a partial transverse sectional view taken on line B—B of FIG. 1 with the modification of FIG. 11 incorporated showing a sloped back side surface of this alternate configuration movably mounted gear cage actuation arm with the wider setable arc control contact member over lapping the narrower sized arc control contact member for continuous 360° driving operation when engaging this sloped back side of the gear cage actuation arm. The partially shown gear cage is shown in its fully counterclockwise position for driving the nozzle assembly and arc control contact member clockwise.

An alternate gear cage actuation arm configuration is shown in FIGS. 11, 11A, 12 and 13. The gear cage assembly actuation arm 294 shown in a side elevational view along line 11—11 if FIG. 13 is a separate part which can be molded and have special purpose shapes on a selected surface which will be explained during the following description.

The actuation arm 294 of the gear cage assembly 218 is shown movably mounted in a cylindrical resilient insert 110 which is configured to have an outer cylindrical member 111 with an inner deflectable cylinder 112 co-axially mounted therein by an integral flange 116. Cylindrical insert 110 is mounted in a cylindrical recess 114 in the upper surface of bottom plate 22''. The inner deflectable cylinder 112 is formed having a closed bottom and having its outer surface connected to the inner surface of the outer cylindrical member 111 by annular flange 116. Cylindrical insert 110 can be made of a neoprene rubber or other similar material. Actuation arm 294 is positioned in the inner deflectable cylinder 112 with its lower end against its bottom.

When the actuation arm 294 is loaded for actuation by one of the arc control contact members 100' or 101', it is deflected to a position as by the dot-dash lines of FIG. 11. This angular movement of actuation arm 294 moves the lower end of the cylinder 112 to contact the inner cylindrical wall of the resilient, or rubber, insert 110 (see FIG. 11A) and its further easier deflection is stopped causing the gear cage assembly 218 to be moved for its shifting action to occur. The initial deflection as shown by the normal vertical position relative to the dot-dash line is available to carry the gear cage assembly 218 over center against an engagement over-center biasing spring 139 as shown in FIG. 8 and as previously explained for the other configurations.

In FIG. 11 a cut-away of a modified bottom plate 22'' of gear cage assembly 218 is shown with an upwardly protruding cylinder 109 into which the rubber insert 110 is pressed for movably mounting the shaped actuation arm 294. A lower projection 214 on bottom plate 22'', as in FIG. 8, extends downwardly from the gear cage bottom plate 22'' into recess 69' formed in base member 4'.

Gear cage projection 214 has a spring seat, or notch, 213 formed therein facing radially outwardly and recess 69' has a cooperating spring seat, or notch, 212 formed on its outer wall facing radially inwardly. With the gear cage assembly 118 in its neutral position, spring seat 213 and spring seat 212 are located on a radial line through the center of the gear cage shaft 25, as previously described.

Gear cage assembly 218 has an over-center spring means 139 extending between spring seat 213 on the projection 214 and spring seat 212 on the outer wall of recess 69'.

The two arc control contact members 100' and 101' mounted on radial flanges 102 and 104, respectively, are shown with a modified elongated upper arc control contact member 100' shown overlapping the smaller circular arc control contact member 101' as for a 360° continuous rotation setting.

Continuous 360° rotation is achieved for the configuration arc control contact members 100' and 101' which have no sloped surfaces because this configuration of shaped actuation arm 294 has a sloped surface 124 on its back side as can be seen in FIG. 12. This surface 124 of actuation arm 294 is engaged by the overlapping portion of the movable arc control contact member 100' when it is set to this overlapping position for 360° of continuous rotational operation. This sloped cam surface 124 only extends for the width of radial flange 102 and cams actuation arm 294 outwardly to a position to pass around contact member 101' without moving the shiftable gear cage assembly.

Figure 14:
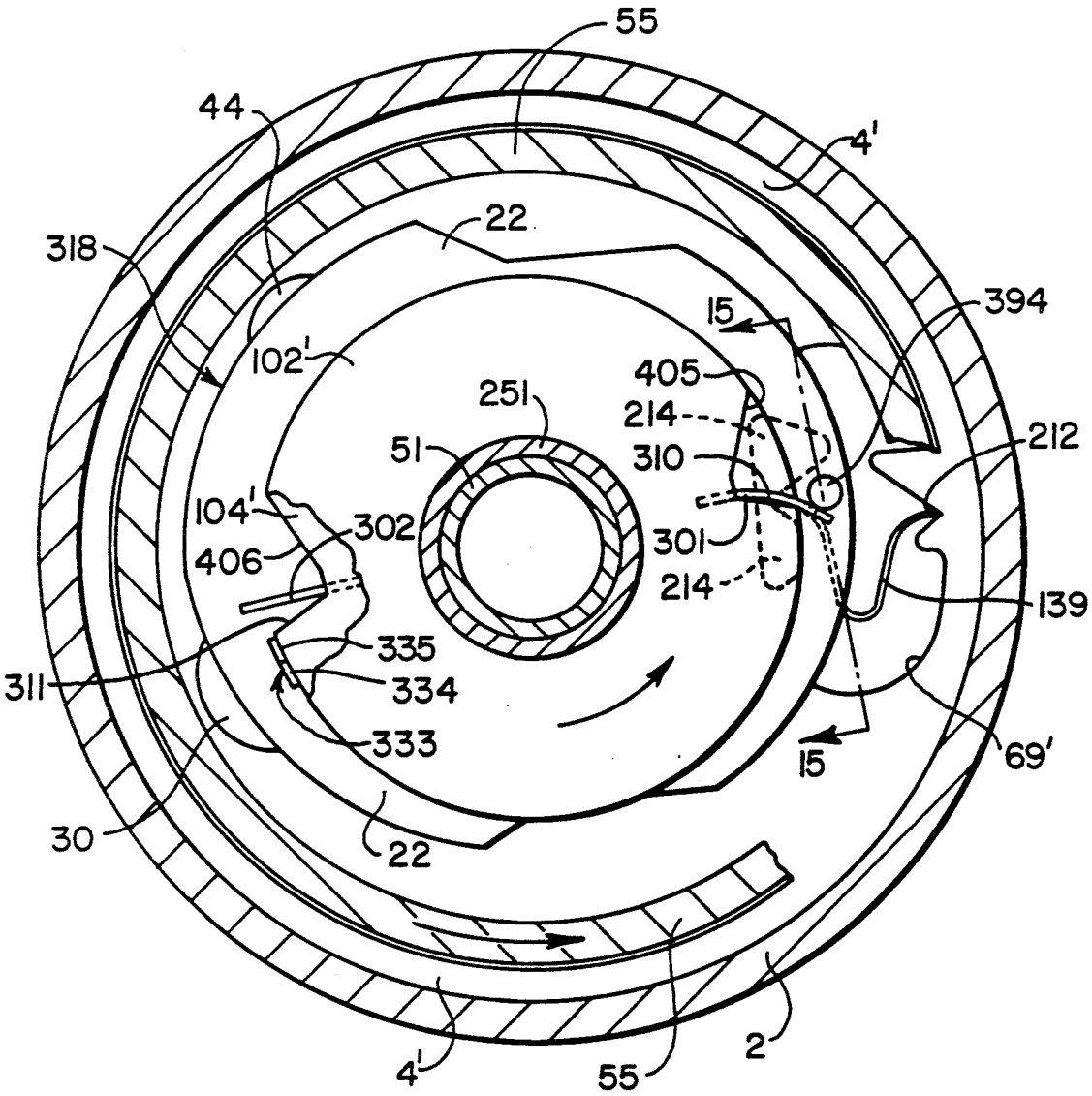
FIG. 14 is a transverse sectional view taken along the line B—B of FIG. 1 but with the reversing gear cage actuation arm wire of FIG. 1 being replaced by a solid rigid actuation post molded as an integral part of the reversing gear cage bottom plate and with the sloped setable upper arc of oscillation control contact member of FIG. 1 being replaced by a movable position biased wire shown deflected after contacting the now rigid reversing actuation arm with the shiftable gear cage shown in its neutral position just prior to its being moved over its reversing center. The shiftable reversing gear cage hair pin wire biasing spring for this configuration is shown replaced by a ribbon bell shaped spring as in FIGS. 8, 9 and 10. Also shown is an arc control contact wire deflection rib which allows for setting for full 360° continuous rotation.

In the configurations shown in FIGS. 14, 15 and 16 the over center carry action for the shiftable drive assembly, or gear cage assembly, 318 is provided by flexible radially projecting arc control contact members 301 and 302 which are movable from a radial position to which they are biased. After being displaced by a loading necessary to over-power the over-center biasing means 139 of the shiftable drive assembly 318 each contact member 301 and 302 carries the shiftable drive assembly 318 over center by its position restoring action against a reversing actuation arm 394 which is a rigid integral part of the shiftable drive assembly 318.

In this modified configuration the radial flanges 102' and 104' have shaped notches 405 and 406 permitting angular movement of the flexible radial projecting arc control contact members 301 and 302. This is very similar to one of the reversing transmission configurations shown in my U.S. Pat. No. 4,901,924 except that here the function of the flexible radial projecting contact members 301 and 302 has been expanded to provide the over center carry function for the shiftable drive assembly, or gear cage assembly, 318 that was previously provided by the over-center biased toggle arm of my U.S. Pat. No. 4,901,924. This is accomplished by providing a small displacement space in each shaped notch 405 and 406 behind the actuating side of the flexible contact members 301 and 302 permitting the flexible contact members 301 and 302 to be bent back to preload them before contacting the end wall 310 and 311, respectively, of the small displacement space. Arc control contact member 301 contacts the rigid actuation arm 394 from one direction as shown in FIG. 14. It is partially deflected, pre-loading it, prior to contacting surface 310 which then stiffens it to allow it to drive the shiftable drive assembly 318 out of driving engagement of terminal gear 30 to the gear cage assembly 318 neutral driving disengaged position as shown in FIG. 14, just prior to the deflection of the movable position bias of the arc control contact member 301 continuing to move the gear cage assembly 318 by its action against its actuation arm 394 over center counterclockwise at which time the over center gear cage bias spring 139 will complete carrying the gear cage counterclockwise for engaging its terminal driving gear 44 for clockwise driving of the output shaft.

A larger contoured notch area on the other side of the flexible arc control contact member 301 allows arc control contact member 301 to be displaced completely out of the way without shifting the gear cage when the actuation arm 394 is contacted by the arc control contact member 301 from the wrong rotation direction.

In FIG. 15 which is a fragmentary side elevation view looking generally along line 15—15 of FIG. 14 with the output driving member removed, the rigid integral gear cage actuation arm 394 is shown being contacted by one of the flexible arc control contact members 301. The arc control contact member 301 is shown having been deflected over to contact the stiffening edge 310 of the shaped notch 405 of the radial flange 102'. Radial flange 104' is also shown which contains another shaped notch 406 for the other flexible arc control contact member 302, not seen in this figure. The gear cage assembly 18 over-center driving engagement bias spring 139 which for this configuration is also shown as a ribbon bell shaped spring is shown in its cavity 69' below the gear cage acting on the integral downwardly protruding rib 214 of shiftable reversing gear cage assembly 18.

As the deflected flexible arc control contact member 301 returns to its normal position biased position of radially straight which position is indicated by the dotted circle Y, the rigid actuation arm 294 will be moved to the right as shown in FIG. 15 carrying the over-center gear cage bias spring 139 and gear cage assembly 318 over center at which time the gear cage bias spring 139 will continue to move the gear cage assembly 318 to its fully counterclockwise position for driving engagement with the ring gear 50 for now driving it clockwise.

For this configuration the ability to set for 360° of operation is provided by camming lug 333 which is shown as an integral lip on the lower radial flange 104' in FIG. 14 and FIG. 16.

In FIG. 16 the camming lug 333 is shown having been repositioned by moving the setable arc control contact member 301 of radial flange 102' clockwise for continuous 360° rotation which cams its flexible arc control contact member up the sloped surface 334 of camming lug 333 and positions it deflected on the top surface 335 of the camming lug 333. In this position it is deflected sufficiently upwardly to pass over the rigid actuation arm 394 of the reversing shiftable assembly 318 without shifting it. The other flexible arc control contact member 302 whose position is also shown in FIG. 16 for the 360° of operation position is not deflected and will contact the reversing actuation arm 294 as shown, for the from left to right rotation of the radial flanges 301 and 302; counterclockwise rotation of the output shaft. However, when flexible arc control contact member 302 contacts the actuation arm 394 from this direction it is simply deflected over into its shaped notch 406 open area and is not stiffened by edge 311 as it is when it contacts the actuation arm 294 for clockwise rotation of the output shaft and radial flanges 301 and 302.

Thus the output drive shaft will continue to rotate counterclockwise without shifting the shiftable gear cage as long as the one movable and position biased arc control contact member 301 is in the upwardly deflected position as shown in FIG. 16.

While the principles of the invention have now been made clear in illustrative embodiments, it will become obvious to those skilled in the art that many modifications in arrangement are possible without departing from those principles. The appended claims are therefore intended to cover and embrace any such modifications, within the limits of the true spirit and scope of the invention.

I claim:

1. A rotary drive sprinkler comprising a sprinkler housing for receiving a supply of water, a nozzle assembly means for directing water therefrom, said sprinkler housing having an output shaft means, said output shaft means being connected to said nozzle assembly means, a rotary drive assembly means for driving said output shaft means, said rotary drive assembly means having a shiftable drive assembly in said housing, actuation means on said shiftable drive assembly for changing the direction of rotation of said output shaft means, said shiftable drive assembly having alternately engageable driving devices for rotating said nozzle assembly means in opposite directions, over-center spring means for holding one of said alternately engaging driving devices of said shiftable drive assembly directly in driving engagement with said output shaft means until the other driving device is to be moved into its driving engagement, two angular limit contact means rotatable with said output shaft means for engagement with said actuation means for changing the direction of rotation of said output shaft means, said actuation means having over center spring carry means, said over center spring carry means being loaded by a cooperating angular limit contact means to carry said shiftable drive assembly over the center of said over-center spring means after the engaged driving device has been removed from driving engagement to reverse the action of said over-center spring means to place said other driving device into driving engagement.

2. A combination as set forth in claim 1 wherein said actuation means comprises a radially extending shifting arm device movably mounted over said shiftable drive assembly, an arcuate recess in the top of said shifting arm device, a coil spring in said recess, an arcuate opening in the bottom of said arcuate recess, an actuation arm extending from said shiftable drive assembly through said arcuate opening into said arcuate recess, said actuation arm extending into a mid-point on said coil spring, said shifting arm device having an actuation member extending upwardly therefrom for contact by said two angular limit contact means.

3. A combination as set forth in claim 1 with means to allow setting for 360° continuous rotation in one direction operation of the output shaft and nozzle assembly.

4. A combination as set forth in claim 3 with means to place the reversing actuation means back into the correct angle of oscillation between the angular limit contact means if forced out of its proper arc of oscillation setting by manual forced rotation of the nozzle and output shaft assembly or during setting and 360° continuous rotation in one direction operation of the output shaft and nozzle assembly.

5. A rotary drive sprinkler as set forth in claim 1 wherein said over center spring carry means is located between the point where the angular limit contact means engages said actuation means and said shiftable drive assembly.

6. A rotary drive sprinkler as set forth in claim 1 wherein said over center spring carry means acts against said over-center spring means from the time an angular limit contact means first contacts the actuation means until the over center spring carry means has carried said shiftable drive assembly over the center of said over-center spring means.

7. A rotary drive sprinkler as set forth in claim 1 wherein said over center spring carry means acts against said shiftable drive assembly and over-center spring means while being loaded by a cooperating angular limit contact means.

8. A rotary drive sprinkler comprising a sprinkler housing for receiving a supply of water, a nozzle assembly means for directing water therefrom, said sprinkler housing having an output shaft means, said output shaft means being connected to said nozzle assembly means having a reversing shiftable drive assembly in said housing, actuation means on said shiftable drive assembly for changing the direction of rotation of said output shaft means, said shiftable drive assembly having alternately engageable driving devices on each side of a center position for rotating said nozzle assembly means in opposite directions, said reversing shiftable drive assembly having both of said driving devices out of engagement at said center position, over-center spring means for biasing each one of said alternately engageing driving devices directly into driving engagement with said output shaft means on each side of said center position, two angular limit contact means rotatable with said output shaft means for contacting said actuation means for changing the direction of rotation of said output shaft means said actuation means including over center spring carry means for moving said shiftable drive assembly over its center position once the one of said driving devices engaged has become disengaged from said output shaft means by the action of one of said two angular limit contact means.

9. A rotary drive sprinkler comprising a sprinkler housing for receiving a supply of water, a nozzle assembly means for directing water therefrom, said sprinkler housing having an output shaft means, said output shaft means being connected to said nozzle assembly means having a reversing shiftable drive assembly in said housing, actuation means on said shiftable drive assembly for changing the direction of rotation of said output shaft means, said shiftable drive assembly having alternately engageable driving devices on each side of a center position for rotating said nozzle assembly means in opposite directions, said reversing shiftable drive assembly having both of said driving devices out of engagement at said center position over-center spring means for biasing each one of said alternately engageing driving devices directly into driving engagement with said output shaft means on each side of said center position until the shiftable drive assembly is biased to be carried over center for said other drive means to be moved into driving position by the action of one of two angular limit contact means rotatable with said nozzle assembly means having caused an over center spring carry means to be displaced a sufficient movement distance to move the shiftable drive assembly over its reversing center position.

10. A rotary drive sprinkler comprising a sprinkler housing for receiving a supply of water, a nozzle assembly means for directing water therefrom, said sprinkler housing having an output shaft means, said output shaft means being connected to said nozzle assembly means, a rotary drive assembly means for driving said output shaft means, said rotary drive assembly means having a reversing shiftable drive assembly in said housing for changing the direction of rotation of said output shaft means, said shiftable drive assembly having alternately engageable driving devices on each side of a center position for rotating said nozzle assembly means in opposite directions, angular limit contact means rotatable with said nozzle assembly, over center spring carry means connected to said shiftable drive assembly, and over-center spring means connected to said shiftable drive assembly for biasing each one of said alternately engageing driving devices of said shiftable drive assembly into driving engagement with said output shaft means on each side of a center position of said shiftable drive assembly until the shiftable drive assembly is biased to be carried over center to permit said other driving device to be moved into driving position by the action of one of said angular limit contact means, said angular limit contact means causes a displacement of said over center spring carry means a sufficient distance to move the shiftable drive assembly over its center position.

11. A rotary drive sprinkler as set forth in claim 10 wherein said over center spring carry means acts against said shiftable drive assembly and over-center spring means while moving through its displacement by a cooperating angular limit contact means.

12. An oscillating sprinkler unit, comprising: a sprinkler head mounted for rotation about a first axis; a drive motor; a reversible gear train for drivingly connecting said drive motor for driving said sprinkler head in alternate directions, comprising final drive gear means connected to said sprinkler head, shiftable drive means comprising alternately operable terminal gear means for carrying said terminal gear means and shiftable to alternately engageable positions with said final drive gear means for driving said sprinkler head in alternate directions; shifting arm means pivotally mounted adjacent said shiftable drive means and movable between alternate shifting positions by engagement with contact means carried by said final drive gear means, and lost motion means for connecting said shifting arm means with said shiftable drive means for shifting said shiftable drive means between said alternately engageable positions upon movement of said shifting arm means between said alternate shifting positions; over-center biasing means for maintaining said shiftable drive means in a selected one of said alternately engageable positions until driven out of engagement to be positively shifted over center to be biased in the opposite direction; and over center spring carry means carried by said shifting arm means for carrying said shiftable drive means over center against the force of said over-center biasing means to bias the shiftable drive means in the opposite direction.

13. A rotary drive sprinkler comprising a sprinkler housing for receiving a supply of water, a nozzle assembly means for directing water therefrom, said sprinkler housing having an output shaft means, said output shaft means being connected to said nozzle assembly means having a reversing shiftable drive assembly in said housing, reversing actuation means on said shiftable drive assembly for changing the direction of rotation of said output shaft means, said shiftable drive assembly having alternately engageable driving devices on each side of a center position for rotating said nozzle assembly means in opposite directions, said reversing shiftable drive assembly having both of said driving devices out of engagement at said center position, over-center spring means for biasing each one of said alternately engageing driving devices directly into driving engagement with said output shaft means on each side of said center position, two angular limit contact means rotatable with said output shaft means for contacting said reversing actuation means of an over center spring carry means mounted directly on said shiftable drive assembly for accumulating sufficient displacement when acted upon by said angular limit contact means before over powering the shiftable drive assembly over-center bias to move the shiftable drive assembly over center causing the over-center spring means on the shiftable drive assembly to be reversed moving the other driving device of said shiftable drive assembly into driving engagement reversing the direction of rotation of said output shaft.

14. A combination as set forth in claim 13 where said angular limit contact means are mounted for relative rotational movement to change the desired angle of oscillation of said output shaft means and nozzle assembly means, one of said angular limit contact means being elongated with a sloped back surface to permit the actuation means to pass over the normal contact surface of both of said angular limit contact means to cam the reversing actuation means out of reversing shifting position and allow continuous 360° rotation of the output shaft in one direction.

15. A combination as set forth in claim 14 with means to place the reversing actuation means back into the correct angle of oscillation between the angular limit contact means if forced out of its proper arc of oscillatoin setting by if forced out of its proper arc of oscillation setting by manual forced rotation of the nozzle and output shaft assembly or during setting and 360° continuous rotation in one direction operation of the output shaft and nozzle assembly.

16. A rotary drive sprinkler comprising a sprinkler housing for receiving a supply of water, a nozzle assembly means for directing water therefrom, said sprinkler housing having an output shaft means, said output shaft means being connected to said nozzle assembly means, a rotary drive assembly means for driving said output shaft means, said rotary drive assembly means having a shiftable drive assembly in said housing, actuation means on said shiftable drive assembly for changing the direction of rotation of said output shaft means, said shiftable drive assembly having alternately engageable driving devices for rotating said nozzle assembly means in opposite directions, an over-center spring means for holding one of said alternately engaging driving devices directly in driving engagement with said output shaft means on each side of a center position until an over center spring carry means is prepared to pull said shiftable drive assembly disengaging said one driving device and pull said shiftable drive assembly over the center position to permit the over-center spring means to drive said other driving device into engagement, two angular limit contact means rotatable with said output shaft means for contacting said actuation means for changing the direction of rotation of said output shaft means.

17. A rotary drive sprinkler comprising a sprinkler housing for receiving a supply of water, a nozzle assembly means for directing water therefrom, said sprinkler housing having an output shaft means, said output shaft means being connected to said nozzle assembly means having a reversing shiftable drive assembly in said housing, actuation means on said shiftable drive assembly for changing the direction of rotation of said output shaft means, said reversing shiftable drive assembly having alternately engageable driving devices on each side of a center position for rotating said nozzle assembly means in opposite directions, said reversing shiftable drive assembly having both of said driving devices out of engagement at said center position, over-center spring means for biasing each one of said alternately engaging driving devices directly into driving engagement with said output shaft means on each side of said center position, two angular limit contact means rotatable with said output shaft means for contacting said actuation means for changing the direction of rotation of said output shaft means, said actuation means including over center spring carry means for moving said reversing shiftable drive assembly over its center position once the one of said driving devices engaged has become disengaged from said output shaft means.

18. A combination as set forth in claim 17 wherein said actuation means comprises a movable actuation member, said movable actuation member being movable in relation to said reversing shiftable drive assembly so that when an angular limit contact means moves said movable actuation member said over center spring carry means is deflected an amount which is sufficient to carry said reversing shiftable drive assembly over said center position when the over-center spring means has been overpowered to disengage the engaged driving device.

19. A combination as set forth in claim 17 wherein said actuation means comprises a spring wire actuation member which extends upwardly from said shiftable drive assembly.

20. A combination as set forth in claim 17 wherein said reversing shiftable drive assembly is driven by a turbine, said turbine being driven in only one direction by a flow of water through said sprinkler housing.

21. A combination as set forth in claim 17 wherein said over-center spring means is located below said reversing shiftable drive assembly and extends between said reversing shiftable drive assembly and said sprinkler housing, said over-center spring means comprises a spring wire member having two radially extending wire spring arms, one wire arm being connected to said reversing shiftable drive assembly, the other wire arm being connected to said sprinkler housing.

22. A combination as set forth in claim 17 wherein said actuation means comprises a movable actuation member, said movable actuation member being movable in relation to said shiftable drive assembly, said movable actuation member comprising a rigid actuation arm, over center spring carry means connecting said rigid actuation arm to said shiftable drive assembly so that when an angular limit contact means moves said rigid actuation arm it is deflected an amount which is sufficient to carry said shiftable drive assembly over center when the over-center spring has been overpowered to disengage the engaged driving device.

23. A combination as set forth in claim 22 including an upwardly facing surface on said shiftable drive assembly, an opening in said upwardly facing surface, an insert mounted in said opening, said insert having a cylindrical opening therein, a cylindrical member having a closed bottom, said cylindrical member being supported at the center of said cylindrical opening by a flexible radially extending annular flange fixed at its outer edge to said insert and to its inner edge to said cylindrical member, said rigid actuation arm having a lower part located in said cylindrical member having a closed bottom.

24. A combination as set forth in claim 17 wherein said two angular limit contact means are movable relative to each other to provide a desired angle of movement of said nozzle assembly means, said angular limit contact means each having a contact side for contacting said actuation means for changing the direction of rotation of said output shaft means, one of said angular limit contact means being sized to cover said other angular limit contact means when they are placed side-by-side, said actuation means having a cam surface in line with said one of said angular limit contact means, said one of said angular limit contact means being sized so that when the end opposite the contact side contacts the cam surface on the actuation means the actuation means is cammed to the side and passes over the covered angular limit contact means, this action permits continuous 360° rotation of said nozzle assembly means in the same direction.

25. A combination as set forth in claim 17 wherein said two angular limit contact means are movable relative to each other to provide a desired angle of movement of said nozzle assembly means, said angular limit contact means each having a contact side for contacting said actuation means for changing the direction of rotation of said output shaft means, one of said angular limit contact means being made to cover said other angular limit contact means when they are placed side-by-side, said one of said angular limit contact means having a contoured surface on the side opposite the contact side so that when the side opposite the contact side contacts the actuation means it is cammed to the side and passes over the covered angular limit contact means, this action permitting continuous 360° rotation of said nozzle assembly means in the same direction.

26. A rotary drive sprinkler as set forth in claim 17 wherein said over center spring carry means continuously biases a driving device of said shiftable drive assembly against the over-center spring means after an angular limit contact means contacts said actuation means until the over center spring carry means has moved said reversing shiftable drive assembly over its center position.

27. A rotary drive sprinkler comprising a sprinkler housing for receiving a supply of water, a nozzle assembly means for directing water therefrom, said sprinkler housing having an output shaft means, said output shaft means being connected to said nozzle assembly means having a reversing shiftable drive assembly in said housing, actuation means on said shiftable drive assembly for changing the direction of rotation of said output shaft means, said shiftable drive assembly having alternately engageable driving devices on each side of a center position for rotating said nozzle assembly means in opposite directions, said reversing shiftable drive assembly having both of said driving devices out of engagement at said center position, over-center spring means for biasing each one of said alternately engageing driving devices directly into driving engagement with said output shaft means on each side of said center position, two deflectable angular limit contact means rotatable with said output shaft means for contacting an actuation post mounted directly on said shiftable drive assembly to be acted upon by said deflectable angular limit contact means to accumulate sufficient deflection to overpower the force of the over-center spring means on the shiftable drive assembly and carry it over center causing the biasing force of the shiftable drive assembly to be reversed moving the other of said driving devices of said shiftable drive assembly into driving engagement reversing the direction of rotation of said output shaft.

28. A combination as set forth in claim 27 where said deflectable angular limit contact means are mounted for relative rotational movement to change the desired angle of oscillation of said output shaft means and nozzle assembly means, camming surface means mounted adjacent one of said deflectable angular limit contact means to deflect the other deflectable angular limit contact means out of a movement path of said reversing shiftable drive assembly actuation post when said angular limit contact means move adjacent to each other to provide for continuous 360° rotation in one direction of the output shaft and nozzle assembly.

29. A combination as set forth in claim 28 with means to place the reversing actuation means back into the correct angle of oscillation between the angular limit contact means if forced out of its proper arc of oscillation setting by manual forced rotation of the nozzle and output shaft assembly or during setting and 360° continuous rotation in one direction operation of the output shaft and nozzle assembly.

30. A combination as set forth in claim 27 with means to place the reversing actuation means back into the correct angle of oscillation between the angular limit contact means if forced out of its proper arc of oscillation setting by manual forced rotation of the nozzle and output shaft assembly or during setting and 360° continuous rotation in one direction operation of the output shaft and nozzle assembly.

31. A rotary drive sprinkler comprising a sprinkler housing for receiving a supply of water, a nozzle assembly means for directing water therefrom, said sprinkler housing having an output shaft means, said output shaft means being connected to said nozzle assembly means for rotating it, a reversing shiftable drive assembly in said housing, said reversing shiftable drive assembly providing for driving engagement with said output shaft means on each side of a reversing center position, actuation means for changing the direction of rotation of said output shaft means to provide for oscillation, two angular limit contact means for controlling the desired angle of oscillation of said output shaft means, two counter-rotating driving devices, said reversing shiftable drive assembly alternately placing said driving devices into driving engagement with said output shaft means on each side of said reversing center position for rotating said nozzle assembly means in opposite directions, said reversing shiftable drive assembly placing both of said driving devices out of driving engagement at said reversing center position, over center spring carry means for moving said shiftable drive assembly over its reversing center position, over-center spring means for alternately biasing each one of said driving devices into driving engagement with said output shaft means on each side of said reversing center position, said over center spring carry means being loaded by the action of one of said two angular limit contact means to carry said shiftable drive assembly over its reversing center position for a driving device to be put into driving engagement by said over-center spring means, said one of said two angular limit contact means having caused said over center spring carry means to be displaced a sufficient distance to move the shiftable drive assembly over its reversing center position when one of said driving devices has been driven out of engagement.

32. A rotary drive sprinkler as set forth in claim 31 including means to place the reversing actuation means back into the correct angle of oscillation between the angular limit contact means if forced out of its proper arc of oscillation setting by manual forced rotation of the nozzle and output shaft assembly or during setting and 360° continuous rotation in one direction operation of the output shaft and nozzle assembly.

33. A rotary drive sprinkler as set forth in claim 31 wherein said over center spring carry means acts against said shiftable drive assembly and over-center spring means while being displaced a sufficient distance to move the shiftable drive assembly over its reversing center position once the engaged driving device has become disengaged.

* * * * *